US012428816B2

(12) United States Patent
Ishii et al.

(10) Patent No.: US 12,428,816 B2
(45) Date of Patent: Sep. 30, 2025

(54) WORK MACHINE

(71) Applicant: HITACHI CONSTRUCTION MACHINERY CO., LTD., Tokyo (JP)

(72) Inventors: Hiroki Ishii, Tsuchiura (JP); Shinjiro Yamamoto, Ami-Machi (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 265 days.

(21) Appl. No.: 18/026,621

(22) PCT Filed: Feb. 4, 2022

(86) PCT No.: PCT/JP2022/004510
§ 371 (c)(1),
(2) Date: Mar. 16, 2023

(87) PCT Pub. No.: WO2022/201905
PCT Pub. Date: Sep. 29, 2022

(65) Prior Publication Data

US 2023/0332379 A1 Oct. 19, 2023

(30) Foreign Application Priority Data

Mar. 26, 2021 (JP) ..... 2021-053390

(51) Int. Cl.
*E02F 9/22* (2006.01)

(52) U.S. Cl.
CPC ..... *E02F 9/2278* (2013.01); *E02F 9/2203* (2013.01)

(58) Field of Classification Search
None
See application file for complete search history.

(56) References Cited

U.S. PATENT DOCUMENTS

2011/0000203 A1* 1/2011 Riedel ..... F15B 21/087 60/327
2014/0121840 A1 5/2014 Mizuochi et al.
(Continued)

FOREIGN PATENT DOCUMENTS

CN 105518220 B * 11/2017 ..... E02F 3/32
DE 112012001035 T5 * 11/2013 ..... E02F 9/2228
(Continued)

OTHER PUBLICATIONS

International Search Report of PCT/JP2022/004510 dated Apr. 26, 2022.
(Continued)

*Primary Examiner* — Peter D Nolan
*Assistant Examiner* — Matthew Cobb
(74) *Attorney, Agent, or Firm* — Mattingly & Malur, PC

(57) ABSTRACT

A work machine includes hydraulic actuators that drive a work implement, and a controller configured to output a control signal for controlling each hydraulic actuator on the basis of a velocity command to each actuator computed at each computation cycle. When controlling an action of a first hydraulic actuator under a predetermined condition according to an action of a second hydraulic actuator, the controller computes a velocity command to the first hydraulic actuator at a current computation cycle, with use of an actual velocity of each hydraulic actuator at the current computation cycle computed on the basis of a sensing signal of a posture sensor and a history of past velocity commands to each hydraulic actuator computed at previous computation cycles before the current computation cycle, and outputs a control signal according to the velocity command to the first hydraulic actuator at the current computation cycle.

8 Claims, 14 Drawing Sheets

(56) References Cited

U.S. PATENT DOCUMENTS

| | | | | |
|---|---|---|---|---|
| 2017/0284056 | A1 | 10/2017 | Mizuochi et al. | |
| 2020/0018037 | A1* | 1/2020 | Nakamura | E02F 3/43 |
| 2020/0157768 | A1 | 5/2020 | Ito et al. | |
| 2021/0262191 | A1 | 8/2021 | Ito | |

FOREIGN PATENT DOCUMENTS

| | | | | |
|---|---|---|---|---|
| EP | 0 905 325 | A1 | 3/1999 | |
| JP | 62-189223 | A | 8/1987 | |
| JP | 05-195547 | A | 8/1993 | |
| JP | 2017-179929 | A | 10/2017 | |
| JP | 2019-060132 | A | 4/2019 | |
| WO | 2012169531 | A1 | 12/2012 | |
| WO | 2019053814 | A1 | 3/2019 | |
| WO | WO-2019043898 | A1 * | 3/2019 | E02F 3/43 |
| WO | 2020101004 | A1 | 5/2020 | |
| WO | WO-2021247095 | A1 * | 12/2021 | |

OTHER PUBLICATIONS

International Preliminary Report on Patentability received in corresponding International Application No. PCT/JP2022/004510 dated Oct. 5, 2023.

Extended European Search Report received in corresponding European Application No. 22774706.0 dated Jan. 21, 2025.

* cited by examiner

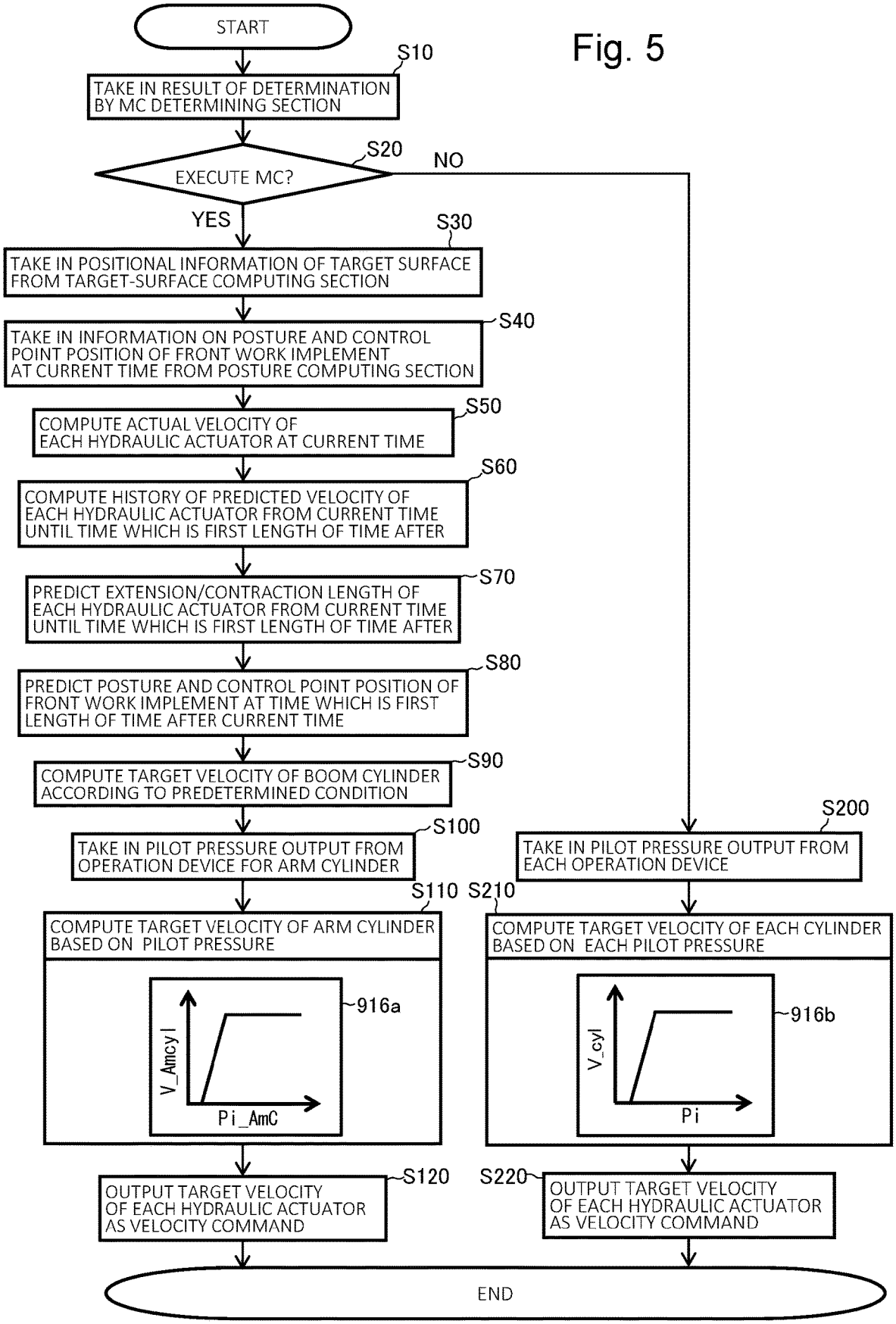
Fig. 5
START
S10
TAKE IN RESULT OF DETERMINATION BY MC DETERMINING SECTION
S20
EXECUTE MC?
NO
YES
S30
TAKE IN POSITIONAL INFORMATION OF TARGET SURFACE FROM TARGET-SURFACE COMPUTING SECTION
S40
TAKE IN INFORMATION ON POSTURE AND CONTROL POINT POSITION OF FRONT WORK IMPLEMENT AT CURRENT TIME FROM POSTURE COMPUTING SECTION
S50
COMPUTE ACTUAL VELOCITY OF EACH HYDRAULIC ACTUATOR AT CURRENT TIME
S60
COMPUTE HISTORY OF PREDICTED VELOCITY OF EACH HYDRAULIC ACTUATOR FROM CURRENT TIME UNTIL TIME WHICH IS FIRST LENGTH OF TIME AFTER
S70
PREDICT EXTENSION/CONTRACTION LENGTH OF EACH HYDRAULIC ACTUATOR FROM CURRENT TIME UNTIL TIME WHICH IS FIRST LENGTH OF TIME AFTER
S80
PREDICT POSTURE AND CONTROL POINT POSITION OF FRONT WORK IMPLEMENT AT TIME WHICH IS FIRST LENGTH OF TIME AFTER CURRENT TIME
S90
COMPUTE TARGET VELOCITY OF BOOM CYLINDER ACCORDING TO PREDETERMINED CONDITION
S100
TAKE IN PILOT PRESSURE OUTPUT FROM OPERATION DEVICE FOR ARM CYLINDER
S110
COMPUTE TARGET VELOCITY OF ARM CYLINDER BASED ON PILOT PRESSURE
916a
V_Amcyl
Pi_AmC
S120
OUTPUT TARGET VELOCITY OF EACH HYDRAULIC ACTUATOR AS VELOCITY COMMAND
S200
TAKE IN PILOT PRESSURE OUTPUT FROM EACH OPERATION DEVICE
S210
COMPUTE TARGET VELOCITY OF EACH CYLINDER BASED ON EACH PILOT PRESSURE
916b
V_cyl
Pi
S220
OUTPUT TARGET VELOCITY OF EACH HYDRAULIC ACTUATOR AS VELOCITY COMMAND
END

WORK MACHINE

TECHNICAL FIELD

The present invention relates to a work machine including a work implement, and in particular relates to a work machine that controls actions of a work implement under a predetermined condition.

BACKGROUND ART

A work machine includes a work implement driven by hydraulic actuators. As a technology to enhance the work efficiency of a work machine, there is one referred to as machine control (MC). MC is a technology to perform operation assistance for an operator by executing semi-automatic control to cause a work implement to perform an action according to a predetermined condition when an operation device is operated by the operator. In MC, for example, control to cause the work implement to perform an action along a predetermined reference plane is executed. In this case, it is required to cause hydraulic actuators to drive stably at velocities dictated by target velocities. For example, in a case where horizontal excavation is performed with MC by a hydraulic excavator including an articulated-type front work implement formed by coupling a boom, an arm, and the like, typically, movement of the front work implement along an excavation target surface (reference plane) requires highly accurate control of the velocity of each hydraulic actuator that drives the arm or the boom since the horizontal excavation is performed by combined actions of arm crowding and boom raising.

For example, Patent Document 1 discloses a technology aimed for preventing a delay of response (e.g., a boom-raising command) of MC regarding the start of actual movement of a hydraulic actuator (e.g., an arm cylinder) that drives a work implement, and stabilizing behavior of the work implement in MC. In the hydraulic excavator described in Patent Document 1, when a predetermined length of time or more has elapsed after the start of operation of the arm, a controller executes MC on the basis of an arm cylinder velocity computed from a sensing value of a posture sensor; on the other hand, immediately after the start of the operation of the arm (the start of movement of the arm), the controller executes MC on the basis of an arm cylinder velocity computed from an operation amount of an operation device. Typically, the velocity computed from the sensing value of the posture sensor is closer to the actual velocity than the velocity computed from the operation amount of the operation device is. However, since the posture sensor cannot sense a postural change until the work implement actually performs an action, response of MC is delayed undesirably at the start of movement of the arm if MC is executed on the basis of the sensing value of the posture sensor. In view of this, MC is executed on the basis of the arm cylinder velocity computed from the operation amount of the operation device, only in a limited period of the start of movement of the arm.

PRIOR ART DOCUMENT

Patent Document

Patent Document 1: WO 2019/053814 A

SUMMARY OF THE INVENTION

Problems to be Solved by the Invention

As mentioned above, it is required to control the velocities of hydraulic actuators with high accuracy in MC. However, there is a problem that the actual velocities of hydraulic actuators respond with delays to velocity commands of a controller for driving the hydraulic actuators. This is because there are many processes after control signals of the controller are output until the hydraulic actuators are actually driven at velocities according to the velocity commands of the controller. For example, the pump displacement of a hydraulic pump is changed according to a velocity command to a hydraulic actuator, and also a flow rate control valve corresponding to the hydraulic actuator is driven according to the velocity command. Further, a hydraulic fluid delivered from the hydraulic pump with the changed pump displacement is supplied to the hydraulic actuator via the driven flow rate control valve, the pressure in the hydraulic actuator rises, and thus, the velocity of the hydraulic actuator changes.

In the technology described in Patent Document 1, a countermeasure against the problem that the actual velocities of hydraulic actuators respond with delays to velocity commands is not taken in situations other than the start of movement of the hydraulic actuators. That is, if a velocity command to a control-subject hydraulic actuator is computed (MC is performed) on the basis of the velocity of another hydraulic actuator computed from a sensing value of a posture sensor, at a time point when the actual velocity of the control-subject hydraulic actuator becomes the velocity command, the velocity of the other hydraulic actuator has already changed to a value different from the velocity on the basis of which the velocity command has been computed. For MC, it is required to cause hydraulic actuators to always drive at velocities dictated by target velocities, and hence, it is desirable that delays of response of the actual velocities of the hydraulic actuators to velocity commands are taken into consideration over the entire period from the start to the end of the actions of the hydraulic actuators.

In addition, in the technology described in Patent Document 1, MC is executed on the basis of the velocity computed from the operation amount of the operation device, at the start of movement of the hydraulic actuator. However, the velocity computed from the operation amount of the operation device may differ significantly from the actual velocity of the hydraulic actuator. If MC is executed based on such a velocity, the action accuracy of the front work implement may deteriorate.

The present invention has been made on the basis of the matters described above, and an object thereof is to provide a work machine that can reduce the influence of a delay of response of the actual velocity of a hydraulic actuator to a velocity command and enhance the action accuracy of a work implement in MC.

Means for Solving the Problems

The present application includes a plurality of means for solving the problems described above. An example thereof is a work machine including a work implement that performs work, a plurality of hydraulic actuators that drive the work implement, a hydraulic pump that supplies a hydraulic fluid to the plurality of hydraulic actuators, a plurality of control valves that each control a flow of the hydraulic fluid supplied from the hydraulic pump to a corresponding one of the plurality of hydraulic actuators, a posture sensor that senses a posture of the work implement, and a controller configured to compute a velocity command to each of the plurality of actuators at each computation cycle and output a control signal for controlling each of the plurality of hydraulic actuators on the basis of the computation-result velocity command to each of the plurality of hydraulic actuators. The controller is configured to, in a case where an action of a first hydraulic actuator in the plurality of hydraulic actuators is controlled under a predetermined condition according to an action of a second hydraulic actuator, compute an actual velocity of each of the plurality of hydraulic actuators at a current computation cycle on the basis of a sensing signal of the posture sensor, compute a velocity command to the first hydraulic actuator at the current computation cycle such that the velocity command satisfies the condition, with use of the computation-result actual velocity of each of the plurality of hydraulic actuators and a history of past velocity commands to each of the plurality of hydraulic actuators computed at previous computation cycles before the current computation cycle, and output a control signal for controlling the first hydraulic actuator on the basis of the computation-result velocity command to the first hydraulic actuator at the current computation cycle.

Advantages of the Invention

According to the present invention, since the velocity command to the first hydraulic actuator at the current computation cycle that satisfies the predetermined condition is computed with use of the actual velocity of each hydraulic actuator at the current computation cycle computed on the basis of the sensing signal of the posture sensor and the history of the past velocity commands to each hydraulic actuator computed at the previous computation cycles before the current computation cycle, it is possible to compute the velocity command to the first hydraulic actuator taking into consideration delays of response of the actual velocities to velocity commands. Accordingly, it is possible to reduce the influence of delays of response of the actual velocities of the hydraulic actuators to velocity commands and enhance the action accuracy of the work implement in MC.

Problems, configurations, and advantages other than those described above are made clear by the following explanation of embodiments.

BRIEF DESCRIPTION OF THE DRAWINGS

FIG. 5 is a flowchart depicting an example of a procedure of computation in a velocity/posture predicting section and a velocity command computing section in the controller depicted in FIG. 4.

MODES FOR CARRYING OUT THE INVENTION

Embodiments of a work machine according to the present invention are explained below by using the figures. A hydraulic excavator is taken as an example of work machines in the explanation of the embodiments. In addition, in this document, regarding the meanings of words like "on," "above," or "below" used together with a term representing a certain shape (e.g., an excavation target surface, etc.), "on" has a meaning related to the "surface" of the certain shape, "above" has a meaning related to "positions higher than the surface" of the certain shape, and "below" has a meaning related to "positions lower than the surface" of the certain shape.

First Embodiment

Figure 1:
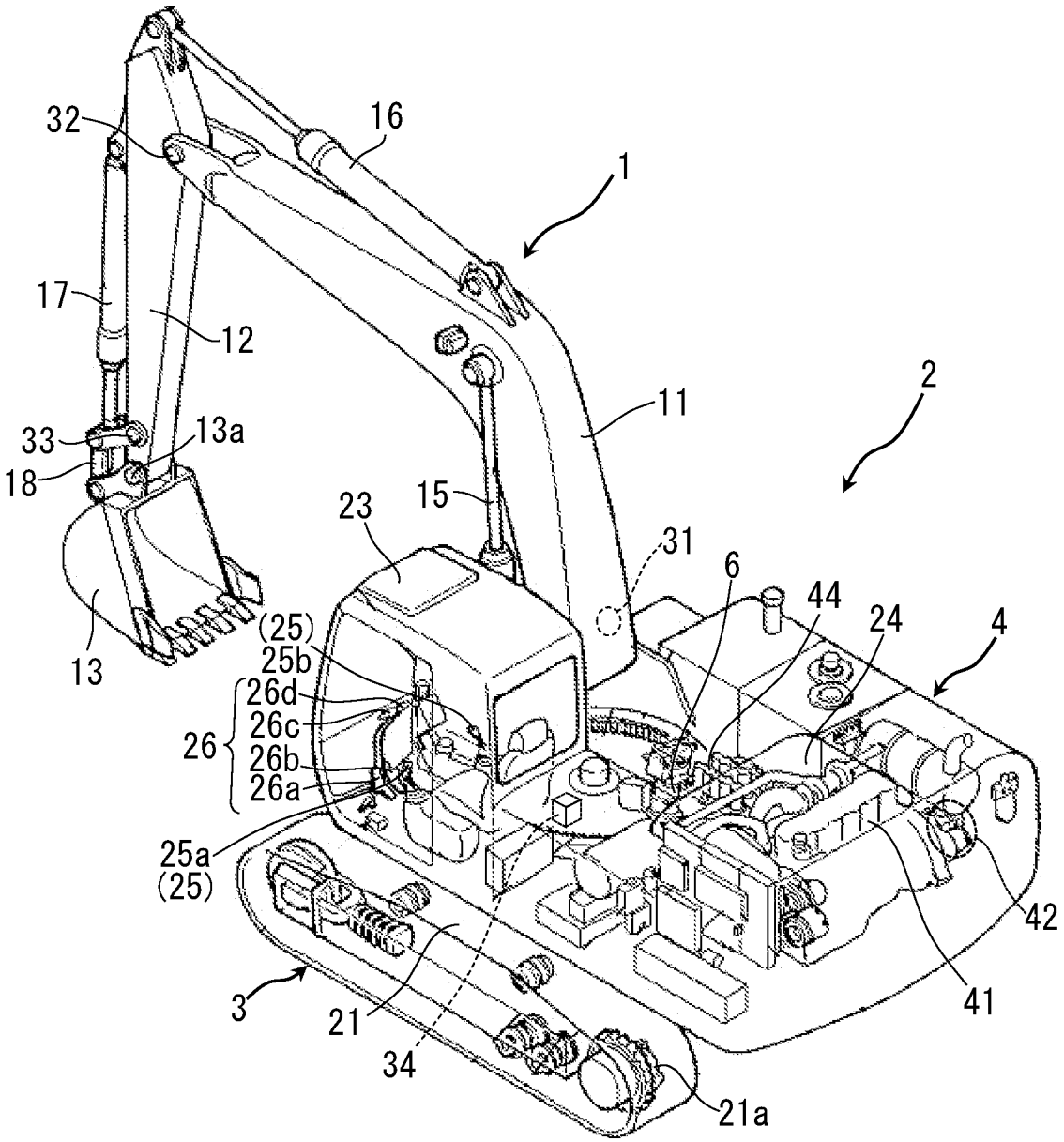
FIG. 1 is a perspective view depicting a hydraulic excavator to which a work machine according to a first embodiment of the present invention is applied.

First, a configuration of a hydraulic excavator to which a work machine according to a first embodiment of the present invention is applied is explained by using FIG. 1. FIG. 1 is a perspective view depicting the hydraulic excavator to which the work machine according to the first embodiment of the present invention is applied. Here, explanations are given by using a direction as seen from an operator seated on the operator's seat.

In FIG. 1, the hydraulic excavator as the work machine includes a front work implement 1 for performing work such as excavation and a body 2 to which the front work implement 1 is attached pivotably. The body 2 includes a lower travel structure 3 that is capable of travelling and an upper swing structure 4 mounted swingably on the lower travel structure 3.

The front work implement 1 is an articulated-type work implement formed by coupling a plurality of driven members in a vertically-pivotable fashion. For example, the plurality of driven members include a boom 11, an arm 12, and a bucket 13 as a work device. A base end portion of the boom 11 is supported pivotably by a front section of the upper swing structure 4 via a boom pin (not depicted). A base end portion of the arm 12 is supported pivotably at a tip portion of the boom 11 via an arm pin (not depicted). The bucket 13 is supported pivotably at a tip portion of the arm 12 via a bucket pin 13*a*. The boom 11, the arm 12, and the bucket 13 are respectively driven by a boom cylinder 15, an arm cylinder 16, and a bucket cylinder 17, which are hydraulic actuators. The bucket 13 is driven via a link member 18 that pivots in conjunction with the bucket 13.

The lower travel structure 3 includes, for example, crawler-type travel devices 21 on its left and right sides (only the left side is depicted). The travel devices 21 are driven by travel hydraulic motors 21*a* which are hydraulic actuators.

For example, the upper swing structure 4 is configured to be swing-driven relative to the lower travel structure 3 by a swing hydraulic motor 6 which is a hydraulic actuator. The upper swing structure 4 includes a cabin 23 in which an operator gets and a machine room 24 that houses various types of equipment.

In the cabin 23, operation devices 25 and 26 (see also FIG. 2 mentioned later) for operating the hydraulic actuators 6, 15 to 17, and 21*a* are arranged. The operation device 25 has operation levers 25*a* and 25*b* that can incline forward, backward, leftward, and rightward. Front-back operation and left-right operation of the operation levers 25*a* and 25*b* are allocated as operation of different ones of the hydraulic actuators. For example, operation of each of the operation levers 25*a* and 25*b* is allocated as operation of the front work implement 1 (boom cylinder 15, arm cylinder 16, bucket cylinder 17), swing operation of the upper swing structure 4 (swing hydraulic motor 6), or the like. The operation device 26 has left and right travel pedals 26*a* and 26*b*, and left and right travel levers 26*c* and 26*d* that can incline forward and backward and are moved in conjunction with operation of the travel pedals 26*a* and 26*b*. The left and right travel pedals 26*a* and 26*b* and travel levers 26*c* and 26*d* are allocated as travel operation of the left and right travel devices 21 (travel hydraulic motors 21*a*). Details of the operation devices are mentioned later. In addition, a display device 27 (see FIG. 3 mentioned later) that displays various types of information related to the hydraulic excavator, a setting screen, and the like is arranged in the cabin 23.

In the machine room 24, a prime mover 41, a hydraulic pump 42, a pilot pump 43 (see FIG. 2 mentioned later), and the like are arranged. In addition, a control valve unit 44 which is a group of a plurality of control valves including flow rate control valves mentioned later (see FIG. 2 mentioned later) is arranged.

A boom-angle sensor 31 that senses a physical quantity (postural information) related to the posture of the boom 11 is installed on the boom 11. For example, the boom-angle sensor 31 is a rotary potentiometer attached to the boom pin, which is a coupling portion between the boom 11 and the upper swing structure 4, and senses a relative pivot angle (boom angle) of the boom 11 relative to the upper swing structure 4.

An arm-angle sensor 32 that senses a physical quantity (postural information) related to the posture of the arm 12 is installed on the arm 12. For example, the arm-angle sensor 32 is a rotary potentiometer attached to the arm pin, which is a coupling portion between the boom 11 and the arm 12, and senses a relative pivot angle (arm angle) of the arm 12 relative to the boom 11.

A bucket-angle sensor 33 that senses a physical quantity (postural information) related to the posture of the bucket 13 is installed on the bucket 13. For example, the bucket-angle sensor 33 is a rotary potentiometer attached to the link member 18 and senses a relative pivot angle (bucket angle) of the bucket 13 relative to the arm 12.

A body-inclination-angle sensor 34 that senses a physical quantity (postural information) related to the posture of the body 2 is installed on the upper swing structure 4. The body-inclination-angle sensor 34 senses an inclination angle (body angle) of the upper swing structure 4 (body 2) relative to a reference plane (e.g., the horizontal plane).

The four sensors, namely, the boom-angle sensor 31, the arm-angle sensor 32, the bucket-angle sensor 33, and the body-inclination-angle sensor 34, constitute a posture sensor 30 that senses physical quantities (postural information) related to the posture of the front work implement 1. The sensors 31 to 34 as the posture sensor 30 output, to a controller 80 mentioned later (see FIG. 3 mentioned later), sensing values (sensing signals) as postural information of the front work implement 1 (boom angle, arm angle, bucket angle, and body angle). Note that the angle sensors 31 to 33 can be replaced with inclination angle sensors or inertial measurement units (IMUs), or stroke sensors that can be installed on the hydraulic cylinders 15 to 17, or the like.

Figure 2:
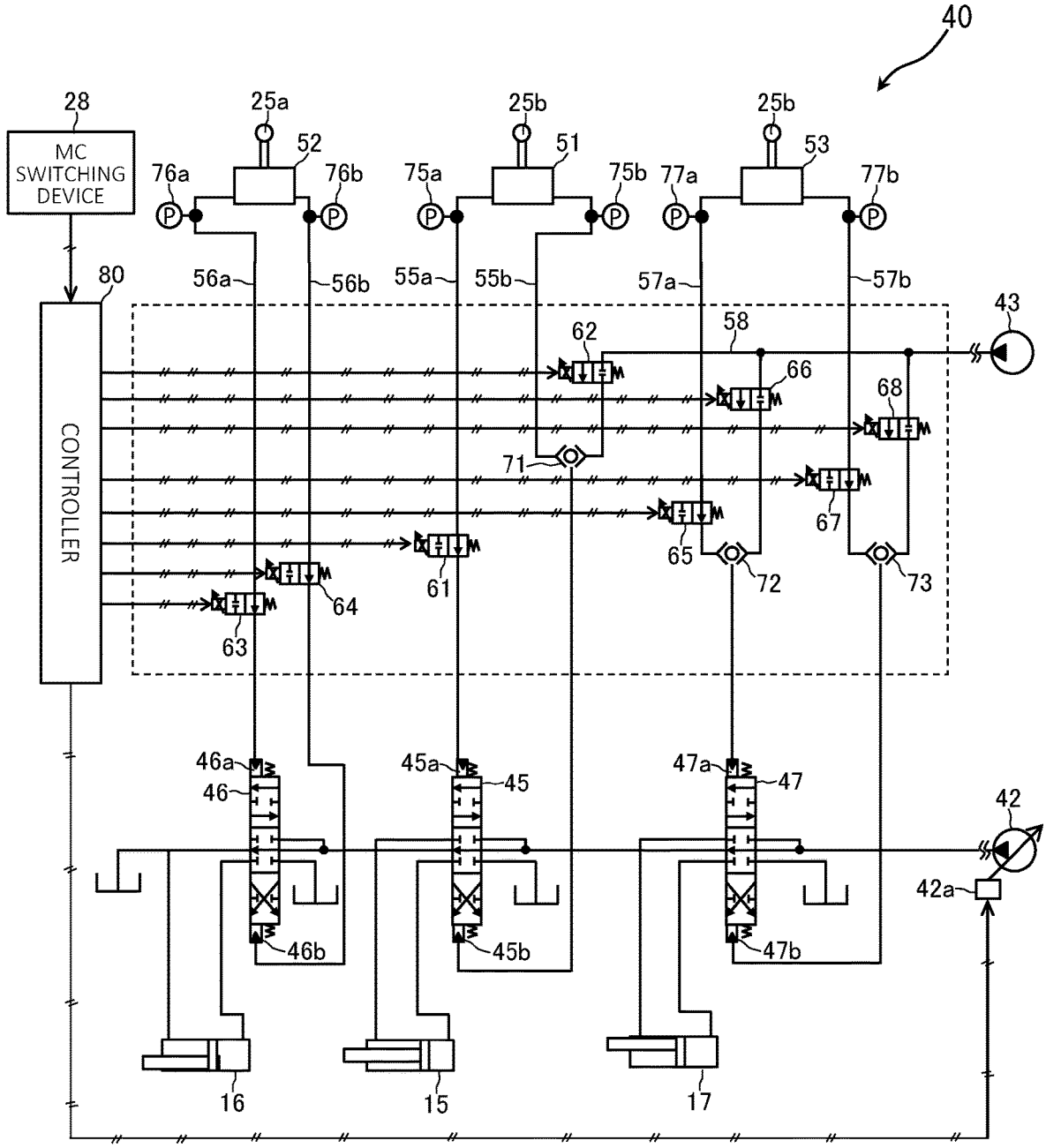
FIG. 2 is a hydraulic circuit diagram depicting a hydraulic system mounted on the work machine according to the first embodiment of the present invention.

Next, a configuration of a hydraulic system in the work machine according to the first embodiment of the present invention is explained by using FIG. 2. FIG. 2 is a hydraulic circuit diagram depicting the hydraulic system mounted on the work machine according to the first embodiment of the present invention.

In FIG. 2, the hydraulic excavator includes a hydraulic system 40 that causes the front work implement 1, the lower travel structure 3, and the upper swing structure 4 (see FIG. 1 regarding all of them) to be driven by hydraulic pressure. Note that only hydraulic circuits related to the boom cylinder 15, the arm cylinder 16, and the bucket cylinder 17, which are hydraulic actuators to drive the front work implement 1, are depicted in FIG. 2, and hydraulic circuits related to the travel hydraulic motors 21*a* that drives the travel devices 21 and the swing hydraulic motor 6 that drives the upper swing structure 4 are omitted.

The hydraulic system 40 includes the hydraulic pump 42 driven by the prime mover 41, and the plurality of hydraulic actuators (boom cylinder 15, arm cylinder 16, and bucket cylinder 17 in FIG. 2) that are driven by a hydraulic fluid delivered from the hydraulic pump 42. For example, the hydraulic pump 42 is a variable displacement pump and has a regulator 42*a* that regulates the pump displacement. For example, the regulator 42*a* adjusts the pump displacement according to a control signal from the controller 80. The hydraulic fluid delivered by the hydraulic pump 42 is supplied via the flow rate control valves 45 to 47 corresponding to respective hydraulic actuators 15 to 17.

The first flow rate control valve 45 controls the direction and flow rate of the hydraulic fluid to be supplied from the hydraulic pump 42 to the boom cylinder 15. The first flow rate control valve 45 is a hydraulic pilot-type control valve and has, on its both sides, pressure-receiving portions 45*a* and 45*b* that receive pilot pressures. The second flow rate control valve 46 controls the direction and flow rate of the hydraulic fluid to be supplied from the hydraulic pump 42 to the arm cylinder 16. The second flow rate control valve 46 is a hydraulic pilot-type control valve, and has, on its both sides, pressure-receiving portions 46*a* and 46*b* that receive pilot pressures. The third flow rate control valve 47 controls the direction and flow rate of the hydraulic fluid to be supplied from the hydraulic pump 42 to the bucket cylinder 17. The third flow rate control valve 47 is a hydraulic pilot-type control valve and has, on its both sides, pressure-receiving portions 47*a* and 47*b* that receive pilot pressures.

Basically, the hydraulic system 40 is configured such that the boom cylinder 15 is driven by operation of a first operation device 51, the arm cylinder 16 is driven by operation of a second operation device 52, and the bucket cylinder 17 is driven by operation of a third operation device 53. For example, the first operation device 51 and the third operation device 53 share the operation lever 25*b* depicted in FIG. 1, and are configured as a four-way operation type lever device 25 that gives an instruction on an action of either one of the boom cylinder 15 and the bucket cylinder 17 by inclination operation in the front-back direction and also gives an instruction on an action of the other one of the boom cylinder 15 and the bucket cylinder 17 by inclination operation in the left-right direction. In addition, for example, the second operation device 52 and an operation device for swing operation which is not depicted share the operation lever 25*a* depicted in FIG. 1, and are configured as a four-way operation type lever device 25 that gives an instruction on an action of either one of the arm cylinder 16 and the swing hydraulic motor 6 by inclination operation in the front-back direction and also gives an instruction on an action of the other one of the arm cylinder 16 and the swing hydraulic motor 6 by inclination operation in the left-right direction.

For example, each operation device 51 to 53 is a hydraulic pilot-type device and includes a pair of pressure reducing valves. Using a delivery pressure of the pilot pump 43 as the source pressure, each operation device 51 to 53 generates a pilot pressure (referred to as an operating pressure in some cases) according to the operation amount and operation direction of the operation lever 25*a* or 25*b*. Note that a pilot delivery line connecting the pilot pump 43 and each operation device 51 to 53 is omitted in FIG. 2.

The first operation device 51 is connected with the one pressure-receiving portion 45*a* of the first flow rate control valve 45 via one first pilot line 55*a* and also is connected with the other pressure-receiving portion 45*b* of the first flow rate control valve 45 via another first pilot line 55*b*. An operating pressure (pilot pressure) output from the first operation device 51 is used as an operation signal (referred to as a first operation signal in some cases) that drives the first flow rate control valve 45.

A first solenoid proportional valve 61 (boom-lowering velocity-reducing valve) is disposed on the one first pilot line 55*a*. The first solenoid proportional valve 61 reduces the pilot pressure (operating pressure) output from the first operation device 51 on the basis of a control signal from the controller 80 and outputs the reduced pressure as an operation signal (referred to as a second operation signal in some cases) to the one pressure-receiving portion 45*a* of the first flow rate control valve 45. When the pilot pressure (first operation signal or second operation signal) is applied to the one pressure-receiving portion 45*a* of the first flow rate control valve 45, the hydraulic fluid from the hydraulic pump 42 is supplied to a rod side of the boom cylinder 15, the first flow rate control valve 45 is driven in such a direction that the boom cylinder 15 is retraction-driven, and a boom-lowering action is performed.

The other first pilot line 55*b* is connected with a delivery line 58 of the pilot pump 43 via a first shuttle valve 71. A second solenoid proportional valve 62 (boom-raising velocity-increasing valve) is provided on the delivery line 58 connected to the first shuttle valve 71. The second solenoid proportional valve 62 reduces the delivery pressure of the pilot pump 43 on the basis of a control signal from the controller 80 and outputs the reduced pilot pressure as an operation signal (referred to as a second operation signal in some cases) to the first shuttle valve 71. The first shuttle valve 71 has a primary-side port that is connected to the first operation device 51 via the other first pilot line 55*b* and also connected to a secondary-port side of the second solenoid proportional valve 62 via the delivery line 58, and has a secondary-port side that is connected to the other pressure-receiving portion 45*b* of the first flow rate control valve 45 via the other first pilot line 55*b*. That is, the first shuttle valve 71 selects a high-pressure-side pilot pressure from the pilot pressure (first operation signal) output from the first operation device 51 and the pilot pressure (second operation signal) output from the second solenoid proportional valve 62 and outputs the selected pilot pressure to the other pressure-receiving portion 45*b* of the first flow rate control valve 45. When the pilot pressure (first operation signal or second operation signal) is applied to the other pressure-receiving portion 45*b* of the first flow rate control valve 45, the hydraulic fluid from the hydraulic pump 42 is supplied to a bottom side of the boom cylinder 15, the first flow rate control valve 45 is driven in such a direction that the boom cylinder 15 is extension-driven, and a boom-raising action is performed.

The second operation device 52 is connected with the one pressure-receiving portion 46*a* of the second flow rate control valve 46 via one second pilot line 56*a* and also is connected with the other pressure-receiving portion 46*b* of the second flow rate control valve 46 via another second pilot line 56*b*. An operating pressure (pilot pressure) output from the second operation device 52 is used as an operation signal (referred to as a first operation signal in some cases) that drives the second flow rate control valve 46.

A third solenoid proportional valve 63 (arm-dumping velocity-reducing valve) is disposed on the one second pilot line 56*a*. The third solenoid proportional valve 63 reduces the pilot pressure (operating pressure) output from the second operation device 52 based on a control signal from the controller 80 and outputs the reduced pressure as an operation signal (referred to as a second operation signal in some cases) to the one pressure-receiving portion 46*a* of the second flow rate control valve 46. When the pilot pressure (first operation signal or second operation signal) is applied to the one pressure-receiving portion 46*a* of the second flow rate control valve 46, the hydraulic fluid from the hydraulic pump 42 is supplied to a rod side of the arm cylinder 16, the second flow rate control valve 46 is driven in such a direction that the arm cylinder 16 is retraction-driven, and an arm-dumping action is performed.

A fourth solenoid proportional valve 64 (arm-crowding velocity-reducing valve) is disposed on the other second pilot line 56*b*. The fourth solenoid proportional valve 64 reduces the pilot pressure (operating pressure) output from the second operation device 52 based on a control signal from the controller 80 and outputs the reduced pressure as an operation signal (second operation signal) to the other pressure-receiving portion 46*b* of the second flow rate control valve 46. When the pilot pressure (first operation signal or second operation signal) is applied to the other pressure-receiving portion 46*b* of the second flow rate control valve 46, the hydraulic fluid from the hydraulic pump 42 is supplied to a bottom side of the arm cylinder 16, the second flow rate control valve 46 is driven in such a direction that the arm cylinder 16 is extension-driven, and an arm-crowding action is performed.

The third operation device 53 is connected with the one pressure-receiving portion 47*a* of the third flow rate control valve 47 via one third pilot line 57*a* and also is connected with the other pressure-receiving portion 47*b* of the third flow rate control valve 47 via another third pilot line 57*b*. An operating pressure (pilot pressure) output from the third operation device 53 is used as an operation signal (referred to as a first operation signal in some cases) that drives the third flow rate control valve 47.

A fifth solenoid proportional valve 65 (bucket-dumping velocity-reducing valve) is disposed on the one third pilot line 57*a*. A portion which is part of the one third pilot line 57*a* and is located downstream of the fifth solenoid proportional valve 65 is connected with the delivery line 58 of the pilot pump 43 via a second shuttle valve 72. A sixth solenoid proportional valve 66 (bucket-dumping velocity-increasing valve) is disposed on the delivery line 58 connected to the second shuttle valve 72. The fifth solenoid proportional valve 65 reduces the pilot pressure (operating pressure) output from the third operation device 53 based on a control signal from the controller 80 and outputs the reduced pressure as an operation signal (second operation signal) to the second shuttle valve 72. The sixth solenoid proportional valve 66 reduces the delivery pressure of the pilot pump 43 based on a control signal from the controller 80 and outputs the reduced pilot pressure as an operation signal (second operation signal) to the second shuttle valve 72. The second shuttle valve 72 has a primary-side port that is connected to a secondary-port side of the fifth solenoid proportional valve 65 via the one third pilot line 57*a* and also connected to a secondary-port side of the sixth solenoid proportional valve 66 via the delivery line 58, and has a secondary-port side connected to the one pressure-receiving portion 47*a* of the third flow rate control valve 47 via the one third pilot line 57*a*. That is, the second shuttle valve 72 selects a high-pressure-side pilot pressure from the pilot pressure (first operation signal or second operation signal) output from the fifth solenoid proportional valve 65 and the pilot pressure (second operation signal) output from the sixth solenoid proportional valve 66 and outputs the selected pilot pressure to the one pressure-receiving portion 47*a* of the third flow rate control valve 47. When the pilot pressure (first operation signal or second operation signal) is applied to the one pressure-receiving portion 47*a* of the third flow rate control valve 47, the hydraulic fluid from the hydraulic pump 42 is supplied to a rod side of the bucket cylinder 17, the third flow rate control valve 47 is driven in such a direction that the bucket cylinder 17 is retraction-driven, and a bucket-dumping action is performed.

A seventh solenoid proportional valve 67 (bucket-crowding velocity-reducing valve) is disposed on the other third pilot line 57*b*. A portion which is part of the other third pilot line 57*b* and is located downstream of the seventh solenoid proportional valve 67 is connected with the delivery line 58 of the pilot pump 43 via a third shuttle valve 73. An eighth solenoid proportional valve 68 (bucket-crowding velocity-increasing valve) is disposed on the delivery line 58 connected to the third shuttle valve 73. The seventh solenoid proportional valve 67 reduces the pilot pressure (operating pressure) output from the third operation device 53 based on a control signal from the controller 80 and outputs the reduced pressure as an operation signal (second operation signal) to the third shuttle valve 73. The eighth solenoid proportional valve 68 reduces the delivery pressure of the pilot pump 43 based on a control signal from the controller 80 and outputs the reduced pilot pressure as an operation signal (second operation signal) to the third shuttle valve 73. The third shuttle valve 73 has a primary-side port that is connected to a secondary-port side of the seventh solenoid proportional valve 67 via the other third pilot line 57*b* and also connected to a secondary-port side of the eighth solenoid proportional valve 68 via the delivery line 58, and has a secondary-port side that is connected to the other pressure-receiving portion 47*b* of the third flow rate control valve 47 via the other third pilot line 57*b*. That is, the third shuttle valve 73 selects a high-pressure-side pilot pressure from the pilot pressure (first operation signal or second operation signal) output from the seventh solenoid proportional valve 67 and the pilot pressure (second operation signal) output from the eighth solenoid proportional valve 68 and outputs the selected pilot pressure to the other pressure-receiving portion 47*b* of the third flow rate control valve 47. When the pilot pressure (first operation signal or second operation signal) is applied to the other pressure-receiving portion 47*b* of the third flow rate control valve 47, the hydraulic fluid from the hydraulic pump 42 is supplied to a bottom side of the bucket cylinder 17, the third flow rate control valve 47 is driven in such a direction that the bucket cylinder 17 is extension-driven, and a bucket-crowding action is performed.

The solenoid proportional valves 61 to 68 are electrically connected to the controller 80, and the openings of the solenoid proportional valves 61 to 68 are controlled by excitation currents (control signals) from the controller 80. For example, the first, third, fourth, fifth, and seventh solenoid proportional valves 61, 63, 64, 65, and 67 are normally-open solenoid valves whose openings are maximized when not supplied with currents, and their openings decrease to the minimum openings (e.g., openings of zero) in proportion to increases of the excitation currents (control signals) from the controller 80. On the other hand, the second, sixth, and eighth solenoid proportional valves 62, 66, and 68 are normally-closed solenoid valves whose openings are minimized (e.g., openings of zero) when not supplied with currents, and their openings increase to the maximum openings in proportion to increases of the excitation currents (control signals) from the controller 80.

In such a configuration, when the second, sixth, and eighth solenoid proportional valves 62, 66, and 68 are driven by control signals from the controller 80, even in a case where the corresponding operation devices 51 and 53 are not being operated, a pilot pressure as the second operation signal is generated by using the delivery pressure of the pilot pump 43 as the source pressure without operation of the corresponding operation devices 51 and 53, and the second operation signal can be applied to the other pressure-receiving portion 45*b* of the first flow rate control valve 45 or the one or other pressure-receiving portion 47*a* or 47*b* of the third flow rate control valve 47. Because of this, a boom-raising action and a bucket-crowding/dumping action can forcibly be executed. In addition, when the solenoid proportional valves 61, 63, 64, 65, and 67 are driven by the controller 80, a pilot (second operation signal) from which an operating pressure generated by operation of the operation devices 51 to 53 is subtracted is generated and can be applied to the one pressure-receiving portion 45*a* of the first flow rate control valve 45, the one or other pressure-receiving portion 46*a* or 46*b* of the second flow rate control valve 46, and the one or other pressure-receiving portion 47*a* or 47*b* of the third flow rate control valve 47. Because of this, the velocities of a boom-lowering action, an arm-crowding/dumping action, and a bucket-crowding/dumping action can forcibly be lowered from velocities based on the operation amounts of the operation devices 51 to 53.

The one and other first pilot lines 55*a* and 55*b* are provided with first and second pressure sensors 75*a* and 75*b*, respectively, that sense a pilot pressure (first operation signal) generated by the first operation device 51. The first and second pressure sensors 75*a* and 75*b* sense, as the operation amount of the first operation device 51, the pilot pressure generated by the first operation device 51. The first pressure sensor 75*a* senses the operation amount of boom-lowering operation, and the second pressure sensor 75*b* senses the operation amount of boom-raising operation.

The one and other second pilot lines 56*a* and 56*b* are provided with third fourth pressure sensors 76*a* and 76*b*, respectively, that sense a pilot pressure (first operation signal) generated by the second operation device 52. The third and fourth pressure sensors 76*a* and 76*b* sense, as the operation amount of the second operation device 52, the pilot pressure generated by the second operation device 52. The third pressure sensor 76*a* senses the operation amount of arm-dumping operation, and the fourth pressure sensor 76*b* senses the operation amount of arm-crowding operation.

The one and other third pilot lines 57*a* and 57*b* are provided with fifth and sixth pressure sensors 77*a* and 77*b*, respectively, that sense a pilot pressure (first operation signal) generated by the third operation device 53. The fifth and sixth pressure sensors 77*a* and 77*b* sense, as the operation amount of the third operation device 53, the pilot pressure generated by the third operation device 53. The fifth pressure sensor 77*a* senses the operation amount of bucket-dumping operation, and the sixth pressure sensor 77*b* senses the operation amount of bucket-crowding operation.

The pressure sensors 75*a*, 75*b*, 76*a*, 76*b*, 77*a*, and 77*b* function as an operation amount sensor 78 that senses the operation amounts of the operation devices 51 to 53. As the operation amount sensor 78, the pressure sensors 75*a*, 75*b*, 76*a*, 76*b*, 77*a*, and 77*b* are electrically connected to the controller 80 and output sensing values (sensing signals) of pilot pressures (first operation signals) of the operation devices 51 to 53 to the controller 80. Note that a signal line between each pressure sensor 75*a*, 75*b*, 76*a*, 76*b*, 77*a*, or 77*b* and the controller 80 is omitted. In addition, computation of operation amounts by the pressure sensors 75*a*, 75*b*, 76*a*, 76*b*, 77*a*, and 77*b* is merely an example, and for example, operation amounts may be sensed by using position sensors (e.g., rotary encoders) that sense rotational positional changes of the operation levers 25*a* and 25*b* of the operation devices 51 to 53, in another possible configuration.

The controller 80 has a functionality of machine control (hereinafter, referred to as MC) to restrict actions of the front work implement 1 by intervening in operation under a predetermined condition that is determined in advance, in a case where at least one of the first to third operation devices 51 to 53 for operating the front work implement 1 is operated. MC is executed by controlling the first to eighth solenoid proportional valves 61 to 68 depending on the position of a control point of the front work implement 1 (e.g., a claw tip of the bucket 13) or the operational situation of the operation devices 51 to 53. Details of MC by the controller 80 are mentioned later.

The controller 80 is electrically connected with an MC switching device 28. The MC switching device 28 is a switch for an operator to choose to either turn on or turn off MC, and is arranged in the cabin 23 (see FIG. 1). The MC switching device 28 outputs, to the controller 80, an instruction signal (e.g., an ON signal or an OFF signal) for an instruction to turn on or turn off depending on the choice.

In the explanation mentioned above, a pilot pressure generated by operation of the operation devices 51 to 53 and a pilot pressure generated by driving of the solenoid proportional valves 61 to 68 among pilot pressures (operation signals) input to the pressure-receiving portions 45*a*, 45*b*, 46*a*, 46*b*, 47*a*, and 47*b* of the flow rate control valves 45, 46, and 47 are referred to as the "first operation signal" and the "second operation signal," respectively. The second operation signal includes pilot pressures generated by performing correction of reducing pilot pressures (first operation signals) output from the operation devices 51 to 53 by using the solenoid proportional valves 61, 63, 64, 65, and 67, and pilot pressures that are newly generated without using the first operation signal but by reducing the delivery pressure of the pilot pump 43 by using the solenoid proportional valves 62, 66, and 68 without operation of the operation devices 51 to 53.

The second operation signal is generated when a velocity vector of the control point (e.g., the claw tip of the bucket) of the front work implement 1 that is determined according to the first operation signal does not satisfy the predetermined condition that is determined in advance, and is generated as such an operation signal that a velocity vector of the control point of the front work implement 1 to satisfy the predetermined condition is generated. Note that, in a case where the first operation signal and the second operation signal are generated to the one pressure-receiving portion and the other pressure-receiving portion of a single one of the flow rate control valves 45, 46, and 47, the second operation signal is caused to have its effect on the pressure-receiving portion preferentially. This becomes possible by interrupting the first operation signal by using the solenoid proportional valve and also allowing the second operation signal to be input to the pressure-receiving portion. The flow rate control valves 45 to 47 is controlled on the basis of the second operation signal when the second operation signal has been computed, is controlled on the basis of the first operation signal when the second operation signal has not been computed, and is not controlled (driven) when none of the first operation signal and the second operation signal are generated. If the first operation signal and the second operation signal are defined in the manner mentioned above, MC can be regarded as control of the flow rate control valves 45 to 47 based on the second operation signal.

Figure 3:
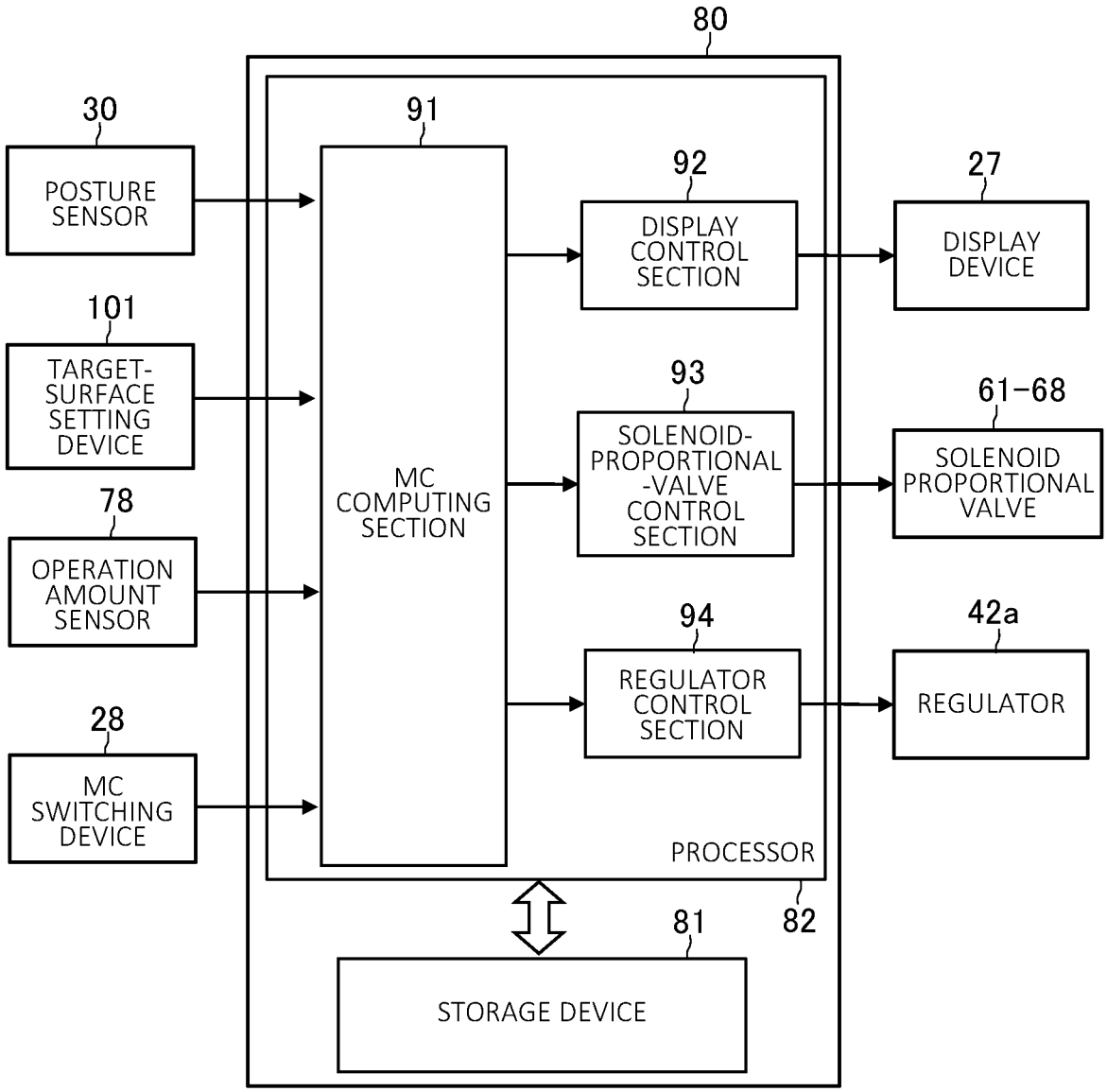
FIG. 3 is a block diagram depicting hardware and functionalities of a controller included as part of the work machine according to the first embodiment of the present invention.

Next, functionalities of the controller in the work machine according to the first embodiment of the present invention are explained by using FIG. 3. FIG. 3 is a block diagram depicting hardware and functionalities of the controller included as part of the work machine according to the first embodiment of the present invention.

The controller 80 executes MC of the front work implement 1 when an instruction for turning on MC (ON signal) is input from the MC switching device 28. For example, in a case where excavating operation (specifically, arm-crowding, bucket-crowding, and/or bucket-dumping operation) is input via the second or third operation device 52 or 53, MC of the front work implement 1 is to control an action of the front work implement 1 by outputting, to a relevant one of the flow rate control valves 45, 46, and 47, a control signal (e.g., a control signal for extending the boom cylinder 15 and forcibly performing a boom-raising action) for forcibly causing at least one of the boom cylinder 15, the arm cylinder 16, and the bucket cylinder 17 to perform an action in such a manner that the control point of the front work implement 1 (e.g., the claw tip of the bucket 13) is kept on an excavation target surface (not depicted) or in an area above the target surface on the basis of a positional relation between the control point of the front work implement 1 and the target surface. Due to this MC, it is possible to prevent the control point of the front work implement 1 from entering an area below the excavation target surface, and perform excavation along the excavation target surface irrespective of the skill level of an operator. Note that it is sufficient that the control point of the front work implement 1 in MC is a tip of the front work implement 1, and the claw tip or bottom surface of the bucket 13, an outermost portion of the link member 18 of the bucket 13, or the like can be selected as the control point.

For example, as depicted in FIG. 3, the controller 80 includes, as its hardware configuration, a storage device 81 including a RAM, a ROM, and the like and a processor 82 including a CPU, an MPU, or the like. The storage device 81 has stored therein in advance programs and various types of information necessary for execution of MC of the front work implement 1. The processor 82 realizes various types of functionality including the following functionalities by reading in programs and various types of information as appropriate from the storage device 81 and executing processes according to the programs.

As functionalities executed by the processor 82, the controller 80 has an MC computing section 91, a display control section 92, a solenoid-proportional-valve control section 93, and a regulator control section 94.

The MC computing section 91 accepts input of sensing signals of postural information of the front work implement 1 (specifically, the boom angle, the arm angle, the bucket angle, and the body angle) sensed by the posture sensor 30. In addition, the MC computing section 91 accepts input of sensing signals of the operation amounts of the operation devices 51 to 53 (specifically, pilot pressures output from the operation devices 51 to 53) sensed by the operation amount sensor 78. Further, the MC computing section 91 accepts input of an instruction signal from the MC switching device 28 (specifically, an ON signal for an instruction for turning on MC or an OFF signal for an instruction for turning off MC). Moreover, the MC computing section 91 accepts input of information about a target surface from a target-surface setting device 101. The target-surface setting device 101 is an interface that accepts input of information on a target surface (specifically, positional information and an inclination angle of a target surface, etc.). For example, the target-surface setting device 101 can be connected with an external terminal (not depicted) having stored therein three-dimensional data of the target surface specified in a global coordinate system (absolute coordinate system), and accepts input of three-dimensional data of the target surface from the external terminal. It should be noted that input of the target surface to the controller 80 via the target-surface setting device 101 can instead be manually input by an operator.

The MC computing section 91 is a section that performs computation for executing MC to forcibly cause at least one of the boom cylinder 15, the arm cylinder 16, and the bucket cylinder 17 to perform an action or to restrict an action of at least one of them in such a manner that the front work implement 1 performs an action according to a predetermined condition that has been determined in advance, in response to operation of the operation devices 51 to 53 by an operator. When the MC computing section 91 has accepted input of an instruction signal (ON signal) for an instruction for turning on MC from the MC switching device 28, the MC computing section 91 performs computation for executing MC in response to operation of the operation devices 51 to 53; on the other hand, when the MC computing section 91 has accepted input of an instruction signal (OFF signal) for an instruction for turning off MC from the MC switching device 28, the MC computing section 91 performs computation for executing control according to operation of the operation devices 51 to 53. On the basis of sensing signals from the posture sensor 30, sensing signals from the operation amount sensor 78, and information from the target-surface setting device 101, the MC computing section 91 eventually computes the posture and control point position (e.g., the claw-tip position of the bucket 13) of the front work implement 1, the position of a target surface, target pilot pressures for driving the flow rate control valves 45, 46, and 47 corresponding to the hydraulic actuators 15, 16, and 17, and target pump displacement of the hydraulic pump 42. Details of functionalities of the MC computing section 91 are mentioned later.

The display control section 92 controls display of the display device 27. Based on a flag included in input information from the MC computing section 91, the display control section 92 reads out a predetermined program from the storage device 81 and controls display of the display device 27. Specifically, on the basis of the posture of the front work implement 1, the claw-tip position of the bucket 13, and the position of the target surface as results of the computation of the MC computing section 91, the display control section 92 causes a display screen of the display device 27 to display a positional relation between the front work implement 1 and the target surface. The storage device 81 has a display ROM having stored therein a large number of pieces of display-related data including images and icons of the front work implement 1, and the display control section 92 uses various types of image data and the like stored in the display ROM.

The solenoid-proportional-valve control section 93 controls, via the first to eighth solenoid proportional valves 61 to 68 of the hydraulic system 40, actions (directions and velocities) of the hydraulic actuators 15 to 17 that drive the front work implement 1. Specifically, on the basis of pilot pressure commands (target pilot pressures) to the flow rate control valves 45 to 47 corresponding to the hydraulic actuators 15 to 17 as results of the computation of the MC computing section 91, the solenoid-proportional-valve control section 93 computes opening commands to the solenoid proportional valves 61 to 68 corresponding to the flow rate control valves 45 to 47 and outputs, to the solenoid proportional valves 61 to 68, control signals (excitation currents) according to the computation results.

The regulator control section 94 controls the pump displacement of the hydraulic pump 42 via the regulator 42*a* of the hydraulic pump 42. Specifically, based on the target pump displacement of the hydraulic pump 42 as a result of the computation of the MC computing section 91, the regulator control section 94 computes a displacement command to the regulator 42*a* of the hydraulic pump 42 and outputs a control signal according to the computation result to the regulator 42*a*.

Figure 4:
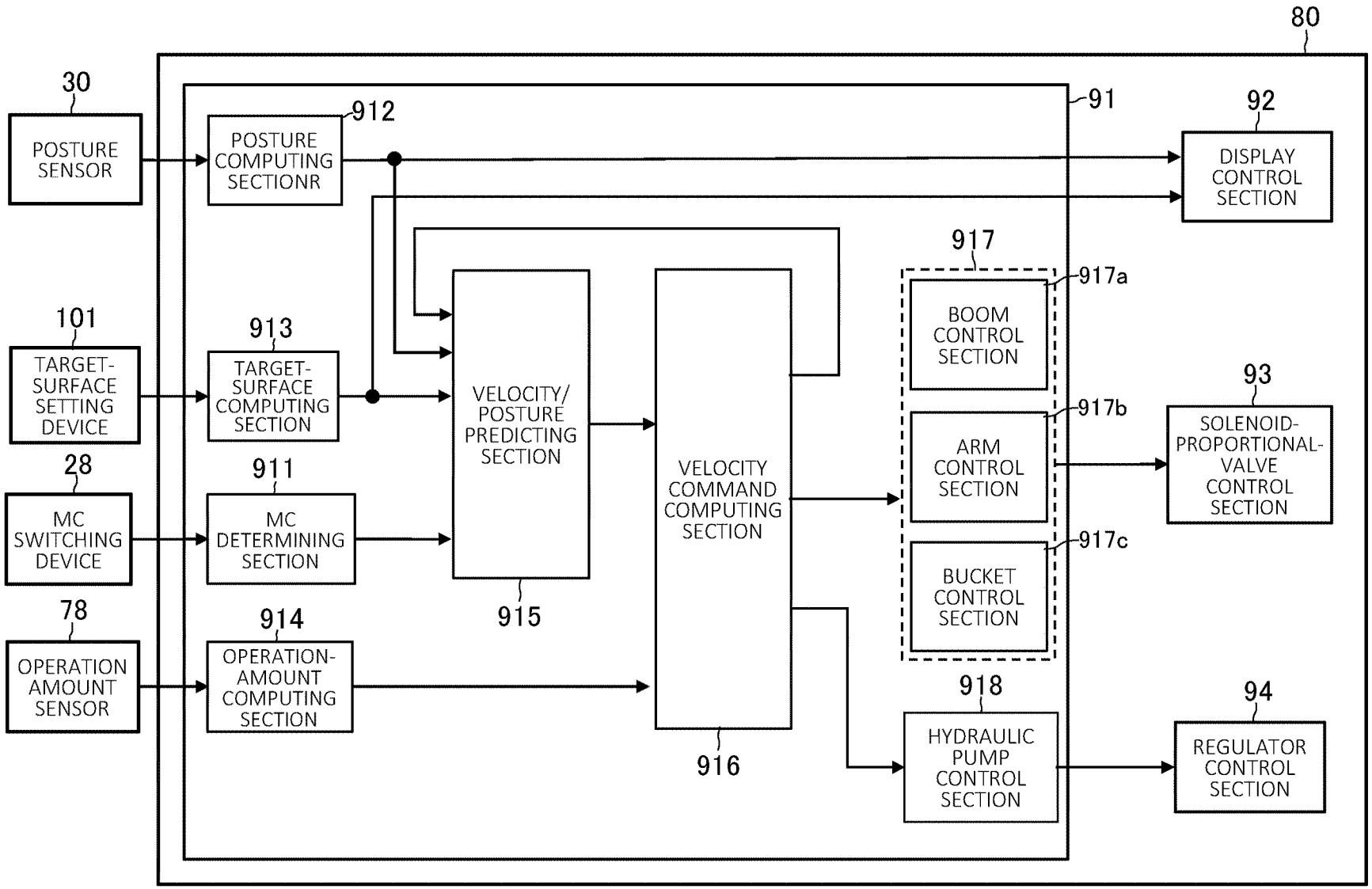
FIG. 4 is a block diagram depicting functionalities of an MC computing section in the controller depicted in FIG. 3.

Next, details of a functional configuration of the MC computing section in the controller in the work machine according to the first embodiment of the present invention are explained by using FIG. 4 and FIG. 5. FIG. 4 is a block diagram depicting functionalities of the MC computing section in the controller depicted in FIG. 3. FIG. 5 is an explanatory diagram depicting a computation method of a velocity/posture predicting section and a velocity command computing section in the controller depicted in FIG. 4.

In FIG. 4, as its subdivided functionalities, the MC computing section 91 in the controller 80 has an MC determining section 911, a posture computing section 912, a target-surface computing section 913, an operation-amount computing section 914, a velocity/posture predicting section 915, a velocity command computing section 916, an actuator control section 917, and a hydraulic pump control section 918. Each functional section in the MC computing section 91 repeatedly executes various types of computation described next at each computation cycle.

The MC determining section 911 determines whether to turn on or turn off MC, on the basis of an instruction signal from the MC switching device 28. The MC switching device 28 outputs, to the velocity/posture predicting section 915, a result of the determination as to whether to turn on or turn off MC.

The posture computing section 912 computes the posture and control point position of the front work implement 1 based on sensing signals from the posture sensor 30. For example, the posture computing section 912 computes the posture of the front work implement 1 and the three-dimensional coordinates of the claw-tip position of the bucket 13 in a local coordinate system. This computation is performed according to typical geometric relations, so detailed explanations thereof are omitted. The posture and control point position of the front work implement 1 as computation results of the posture computing section 912 are output to the display control section 92 and the velocity/posture predicting section 915.

The target-surface computing section 913 computes positional information of target surface based on information from the target-surface setting device 101. The target-surface positional information as a computation result is output to the display control section 92 and the velocity/posture predicting section 915. Note that the target-surface positional information may be stored in the storage device 81.

The operation-amount computing section 914 computes the operation amounts of the operation devices 51 to 53 on the basis of sensing signals from the operation amount sensor 78. An operation amount for boom lowering is computed from a sensing value of the first pressure sensor 75*a*, and an operation amount for boom raising is computed from a sensing value of the second pressure sensor 75*b*. An operation amount for arm dumping is computed from a sensing value of the third pressure sensor 76*a*, and an operation amount for arm crowding is computed from a sensing value of the fourth pressure sensor 76*b*. An operation amount for bucket dumping is computed from a sensing value of the fifth pressure sensor 77*a*, and an operation amount for bucket crowding is computed from a sensing value of the sixth pressure sensor 77*b*. The operation amounts of the operation devices 51 to 53 as computation results of the operation-amount computing section 914 are output to the velocity command computing section 916.

The velocity/posture predicting section 915 computes predicted velocity values of the hydraulic actuators 15 to 17 of the front work implement 1, a predicted posture value of the front work implement 1, and a predicted position value of the control point relative to the target surface at a future time which is a predetermined set length of time after the current time (current computation cycle) corresponding to a time at which the computation is being performed. Specifically, for example, on the basis of the posture and control point position of the front work implement 1 at the current time (current computation cycle) as computation results of the posture computing section 912, the target-surface positional information as a computation result of the target-surface computing section 913, and histories of past velocity commands to the hydraulic actuators 15 to 17 computed by and output from the velocity command computing section 916, mentioned later, from a past time (previous computation cycle) which is a set length of time before the current time (current computation cycle) until the current time, the velocity/posture predicting section 915 computes the predicted values described above at the future time which is the predetermined length of time after the current time. For example, the set length of time described above is set to a first length of time T1 generally matching lengths of time of delays of response of the actual velocities of the hydraulic actuators 15 to 17 to velocity commands. The computation results (predicted values) of the velocity/posture predicting section 915 are output to the velocity command computing section 916. It should be noted that the velocity/posture predicting section 915 is configured to perform the computation of predicted values described above in a case where the velocity/posture predicting section 915 has accepted input of a result of determination to turn on MC from the MC determining section 911, and on the other hand, not to perform the computation of predicted values described above in a case where the velocity/posture predicting section 915 has accepted input of a result of determination to turn off MC from the MC determining section 911. A detailed computation method of the velocity/posture predicting section 915 is mentioned later.

In a case where the result of determination by the MC determining section 911 is to turn on MC, the velocity command computing section 916 computes, as target velocities of the hydraulic actuators, such velocities of the boom cylinder 15 (boom 11), the arm cylinder 16 (arm 12), and the bucket cylinder 17 (bucket 13) that are to be required at the future time which is the set length of time after the current time (current computation cycle), in such a manner that the control point of the front work implement 1 will be positioned on the target surface at the future time which is the set length of time after the current time (current computation cycle). This computation is for controlling an action of the front work implement 1 in such a manner that the control point of the front work implement 1 (e.g., the claw tip of the bucket 13) moves along the target surface without entering an area below the target surface, on the premise that the control point of the front work implement 1 has already been positioned near the target surface. In addition, this computation is for controlling an action of the boom cylinder 15 according to an action of at least one of the arm cylinder 16 and the bucket cylinder 17 under the condition described above. That is, in the present embodiment, the boom cylinder 15 is the subject of a forced action or a restricted action of MC.

Specifically, based on the operation amounts of the operation devices 52 and 53 as sensing results of the operation amount sensor 78, the velocity command computing section 916 computes target velocities of the arm cylinder 16 and the bucket cylinder 17 at the future time which is the first length of time T1 after the current time (current computation cycle). In addition, based on the predicted velocity values of the hydraulic actuators 15 to 17, the predicted posture value of the front work implement 1, and the predicted position value of the control point relative to the target surface as computation results of the velocity/posture predicting section 915, the velocity command computing section 916 computes a target velocity of the boom cylinder 15 satisfying the condition described above at the future time which is the first length of time T1 after the current time (current computation cycle). The velocity command computing section 916 outputs the computation-result target velocities of the hydraulic actuators 15 to 17 as velocity commands at the current time (current computation cycle) to the actuator control section 917 and the hydraulic pump control section 918. Details of this computation method of the velocity command computing section 916 are mentioned later.

In addition, when the result of determination by the MC determining section 911 is to turn off MC, the velocity command computing section 916 computes target velocities of the hydraulic actuators 15 to 17 based on the operation amounts of the operation devices 51 to 53 as sensing results of the operation amount sensor 78. That is, actions of the hydraulic actuators 15 to 17 are controlled according to operation of the operation devices 51 to 53 by an operator, and neither a forced action nor a restricted action of the boom cylinder 15 not according to operation of the operation device 51 by the operator is executed.

The actuator control section 917 performs computation for controlling the hydraulic actuators 15 to 17. Specifically, based on the velocity commands to the hydraulic actuators 15 to 17 as computation results of the velocity command computing section 916, the actuator control section 917 computes target pilot pressures of the flow rate control valves 45 to 47 corresponding to the hydraulic actuators 15 to 17. The actuator control section 917 includes a boom control section 917*a* that controls the first flow rate control valve 45 corresponding to the boom cylinder 15, an arm control section 917*b* that controls the second flow rate control valve 46 corresponding to the arm cylinder 16, and a bucket control section 917*c* that controls the third flow rate control valve 47 corresponding to the bucket cylinder 17.

The boom control section 917*a* computes a target pilot pressure of the first flow rate control valve 45 on the basis of the velocity command to the boom cylinder 15 as a computation result of the velocity command computing section 916, and outputs the computation-result target pilot pressure as a pilot pressure command to the first flow rate control valve 45, to the solenoid-proportional-valve control section 93. The arm control section 917*b* computes a target pilot pressure of the second flow rate control valve 46 on the basis of the velocity command to the arm cylinder 16 as a computation result of the velocity command computing section 916, and outputs the computation-result target pilot pressure as a pilot pressure command to the second flow rate control valve 46, to the solenoid-proportional-valve control section 93. The bucket control section 917*c* computes a target pilot pressure of the third flow rate control valve 47 on the basis of the velocity command to the bucket cylinder 17 as a computation result of the velocity command computing section 916, and outputs the computation-result target pilot pressure as a pilot pressure command to the third flow rate control valve 47, to the solenoid-proportional-valve control section 93.

The hydraulic pump control section 918 performs computation for controlling the pump displacement of the hydraulic pump 42. Specifically, the hydraulic pump control section 918 computes the target pump displacement of the hydraulic pump 42 based on the velocity commands to the plurality of hydraulic actuators 15 to 17 as computation results of the velocity command computing section 916. The hydraulic pump control section 918 outputs the computation-result target pump displacement of the hydraulic pump 42 as a pump displacement command to the regulator control section 94.

Figure 6:
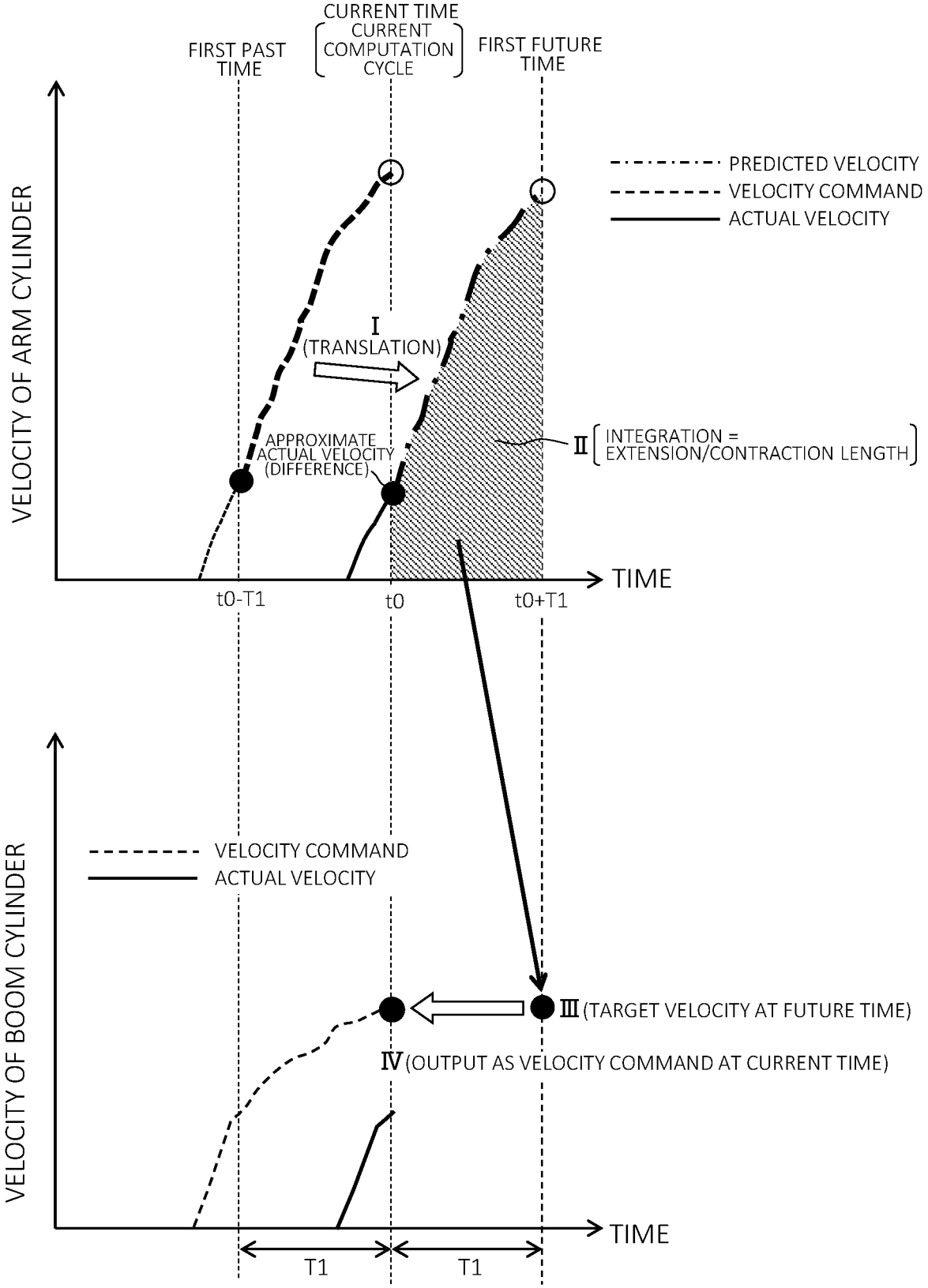
FIG. 6 is an explanatory diagram depicting a computation method of the velocity/posture predicting section and the velocity command computing section in the controller depicted in FIG. 4.

Next, an example of a computation method of the velocity/posture predicting section and the velocity command computing section in the MC computing section in the controller included as part of the work machine according to the first embodiment of the present invention is explained by using FIG. 4 to FIG. 6. FIG. 5 is a flowchart depicting an example of a procedure of computation in the velocity/posture predicting section and the velocity command computing section in the controller depicted in FIG. 4. FIG. 6 is an explanatory diagram depicting a computation method of the velocity/posture predicting section and the velocity command computing section in the controller depicted in FIG. 4. Note that the flowchart depicted in FIG. 5 depicts a computation process for one computation cycle. In FIG. 6, an upper diagram depicts information on the velocity of the arm cylinder, and a lower diagram depicts information on the velocity of the boom cylinder. In addition, solid lines represent actual velocities of the hydraulic actuators, broken lines represent velocity commands to the hydraulic actuators, and a dash-dotted line represents a predicted velocity of the hydraulic actuator.

First, the velocity/posture predicting section 915 in the MC computing section 91 depicted in FIG. 4 takes in a result of determination by the MC determining section 911 (Step S10 in FIG. 5) and determines whether or not to execute MC on the basis of the taken-in result of determination by the MC determining section 911 (whether to turn on or turn off MC) (Step S20 in FIG. 5). When the result of determination by the MC determining section 911 is to turn on MC (turn on), it is determined to execute MC (YES); on the other hand, when the result of determination by the MC determining section 911 is to turn off MC (turn off), it is determined not to execute MC (NO). When the determination result at Step S20 is YES, the procedure proceeds to Step S30; on the other hand, when the determination result at Step S20 is NO, the procedure proceeds to Step S200.

When the determination result at Step S20 is YES, the velocity/posture predicting section 915 takes in positional information of target surface computed on the basis of information from the target-surface setting device 101 by the target-surface computing section 913 (Step S30 depicted in FIG. 5).

Further, the velocity/posture predicting section 915 takes in information on the posture and the position of the control point (e.g., the claw tip of the bucket 13) of the front work implement 1 that are computed by the posture computing section 912 based on sensing signals of the posture sensor 30 (Step S40 in FIG. 5). On the basis of these pieces of information taken in, the velocity/posture predicting section 915 computes the actual velocities of the hydraulic actuators 15 to 17 at the current time (current computation cycle) (Step S50 in FIG. 5). Specifically, from the difference between the postures of the hydraulic actuators (boom cylinder 15, arm cylinder 16, bucket cylinder 17) taken in at the current computation cycle and the postures of the hydraulic actuators 15 to 17 taken in at a computation cycle which is one cycle before the current computation cycle, the velocity/posture predicting section 915 computes the velocities (actual velocities) of the hydraulic actuators 15 to 17 at the current time. This computation is equivalent to a black dot at the current time (current computation cycle) in the upper diagram of FIG. 6. It should be noted that only a case of the arm cylinder 16 is depicted in FIG. 6.

Next, the velocity/posture predicting section 915 computes histories of predicted velocity values of the hydraulic actuators 15 to 17 from the current time (current computation cycle) until a future time (hereinafter, referred to as a first future time in some cases) which is the first length of time T1 after the current time (Step S60 in FIG. 5). Specifically, histories of past velocity commands to the hydraulic actuators 15 to 17 computed and output by the velocity command computing section 916 during a period from a past time (hereinafter, referred to as a first past time in some cases) which is the first length of time T1 before the current time (current computation cycle) until the current time (current computation cycle) are translated toward the velocities (actual velocities) of the hydraulic actuators 15 to 17 at the current time computed at Step S50, and velocity commands to the hydraulic actuators 15 to 17 output at the first past time by the velocity command computing section 916 are caused to match the velocities (actual velocities) of the hydraulic actuators 15 to 17 at the current time computed at Step S50. The translated histories of the velocity commands to the hydraulic actuators 15 to 17 at previous computation cycles are regarded as histories of predicted velocity values of the hydraulic actuators 15 to 17 from the current time until the first future time. That is, histories of future velocities of the hydraulic actuators 15 to 17 in a time interval from the current time until the first future time are predicted on the basis of the histories of the past velocity commands to the hydraulic actuators 15 to 17 output from the velocity command computing section 916 during the period from the first past time until the current time, with the velocities (actual velocities) of the hydraulic actuators 15 to 17 at the current time regarded as reference velocities. This is for taking into consideration the fact that velocity commands to the hydraulic actuators 15 to 17 are attained as the actual velocities of the hydraulic actuators 15 to 17 with response delays of the first length of time T1.

This computation is equivalent to I (translation) depicted in FIG. 6. That is, this computation is equivalent to translating the broken line (velocity commands to the hydraulic actuators 15 to 17) from the first past time (t0−T1) until the current time (t0) in such a manner that the black dot of the velocity command at the first past time (t0−T1) matches the black dot of the actual velocity at the current time (t0), thereby generating the dash-dotted line (predicted velocity values of the hydraulic actuators 15 to 17) from the current time (t0) until the first future time (t0+T1) in the upper diagram of FIG. 6. It should be noted that only a case of the arm cylinder 16 is depicted in FIG. 6. That is, computation equivalent to I (translation) depicted in FIG. 6 is performed also for histories of predicted velocity values of the boom cylinder 15 and the bucket cylinder 17.

Next, the velocity/posture predicting section 915 predicts extension/contraction lengths of the hydraulic actuators 15 to 17 that are produced during a period from the current time until the first future time (Step S70 in FIG. 5). Specifically, the velocity/posture predicting section 915 integrates, over the time interval from the current time until the first future time, the histories of the predicted velocity values of the hydraulic actuators 15 to 17 during the period from the current time until the first future time computed at Step S60 to compute predicted values of extension/contraction lengths of the hydraulic actuators 15 to 17 that are produced during the period from the current time until the first future time.

This computation is equivalent to II (integration=extension/contraction length) depicted in FIG. 6. That is, in the upper diagram of FIG. 6, the area size of a shaded portion surrounded by the time interval from the current time (t0) until the first future time (t0+T1) and the dash-dotted line (histories of the predicted velocity values of the hydraulic actuators 15 to 17) is equivalent to the predicted values of the extension/contraction lengths of the hydraulic actuators 15 to 17. It should be noted that only a case of the arm cylinder 16 is depicted in FIG. 6. That is, computation equivalent to II (integration=extension/contraction length) depicted in FIG. 6 is performed also for predicted values of the extension/contraction lengths of the boom cylinder 15 and the bucket cylinder 17.

Further, the velocity/posture predicting section 915 predicts the posture of the front work implement 1 and a position of the control point relative to the target surface at the first future time (Step S80 in FIG. 5). Specifically, the velocity/posture predicting section 915 computes the posture of the front work implement 1 and the position of the control point relative to the target surface (e.g., the distance from the control point to the target surface) at the first future time, on the basis of the posture of the front work implement 1 (postures of the boom 11, the arm 12, and the bucket 13) and the position of the control point (e.g., the claw tip of the bucket 13) at the current time taken in at Step S40, the predicted values of the extension/contraction lengths of the hydraulic actuators 15 to 17 at the first future time computed at Step S70, and the target-surface positional information taken in at Step S30. The velocity/posture predicting section 915 outputs, to the velocity command computing section 916, the posture of the front work implement 1 and the position of the control point relative to the target surface at the first future time as computation results at Step S80, and the predicted velocity values of the hydraulic actuators 15 to 17 at the first future time as computation results at Step S60.

Next, the velocity command computing section 916 computes a target velocity of the boom cylinder 15 necessary for satisfying the condition mentioned above at the first future time (Step S90 in FIG. 5). Specifically, the velocity command computing section 916 computes such a velocity of the boom cylinder 15 that it becomes possible for the control point of the front work implement 1 to be positioned on the target surface at the first future time, as a target velocity at the first future time, on the basis of the predicted posture value of the front work implement 1 and the predicted position value of the control point relative to the target surface at the first future time computed at Step S80, and the predicted velocity values of the hydraulic actuators 15 to 17 at the first future time computed at Step S60.

The computation from Step S60 to S80 in FIG. 5 is equivalent to a process depicted in FIG. 6 from I (translation) to II (integration=extension/contraction length), and from II through an arrow to III (target velocity at future time). This computation is to compute a command for a forced action of the boom cylinder 15 by activation of MC not according to operation of the operation device 51 under the condition mentioned above, according to an action of at least one of the arm cylinder 16 and the bucket cylinder 17 by operation of the operation devices 52 and 53.

Further, the velocity command computing section 916 takes in a pilot pressure (first operation signal) as an operation amount of the second operation device 52 for the arm cylinder 16 as a computation result of the operation-amount computing section 914 (Step S100 in FIG. 5), and computes a target velocity of the arm cylinder 16 at the first future time based on the pilot pressure taken in (Step S110 in FIG. 5).

For example, the target velocity of the arm cylinder 16 is computed by referring to a preset characteristics diagram 916*a* depicted in FIG. 5. The characteristics diagram 916*a* depicted in FIG. 5 sets a target velocity of the arm cylinder 16 such that the target velocity of the arm cylinder 16 is zero if a pilot pressure (first operation signal) of the second operation device 52 is within a certain range including zero (dead zone), increases in proportion to increase in the pilot pressure after the pilot pressure goes out of the dead zone, and then is a constant value after the pilot pressure exceeds a certain value.

It is supposed in this explanation that an action of the boom cylinder 15 is controlled by MC when the second operation device 52 for the arm cylinder 16 is operated by an operator. Because of this, the operation amount of the third operation device 53 for the bucket cylinder 17 is zero, and hence, an explanation about computation of a target velocity of the bucket cylinder 17 is omitted. However, in a case where the third operation device 53 for the bucket cylinder 17 is also being operated, similarly to the case of the arm cylinder 16, a pilot pressure (first operation signal) as the operation amount of the third operation device 53 is taken in (Step S100 in FIG. 5), and a target velocity of the bucket cylinder 17 at the first future time is computed based on the pilot pressure taken in (Step S110 in FIG. 5).

Finally, the velocity command computing section 916 outputs the target velocity of the boom cylinder 15 at the first future time computed at Step S90, as a velocity command to the boom cylinder 15 at the current time (current computation cycle), and also outputs the target velocity of the arm cylinder 16 at the first future time computed at Step S110, as a velocity command to the arm cylinder 16 at the current time (current computation cycle) (Step S120 in FIG. 5). A relation between a target velocity and a velocity command of the boom cylinder 15 at Step S120 is equivalent to a process of a thick white arrow from the black dot of III (target velocity at future time) to the black dot of IV (output as velocity command at current time) depicted in FIG. 6. This is for taking into consideration the fact that a velocity command to the boom cylinder 15 is achieved as the actual velocity of the boom cylinder 15 with a response delay of the first length of time T1 after the velocity command is output. In a case where the third operation device 53 for the bucket cylinder 17 is also being operated, similarly to the case of the arm cylinder 16, a target velocity of the bucket cylinder 17 at the first future time is output as a velocity command to the bucket cylinder 17 at the current time (current computation cycle) (Step S120 in FIG. 5). Velocity commands to the hydraulic actuators 15 to 17 are output to the actuator control section 917 and the hydraulic pump control section 918. With the end of Step S120, this computation cycle ends, the procedure returns to the start, and the next computation cycle is started.

On the other hand, when the determination result at Step S20 is NO, the velocity command computing section 916 takes in pilot pressures as the operation amounts of the operation devices 51 to 53 corresponding to the hydraulic actuators 15 to 17 which are computation results of the operation-amount computing section 914 (Step S200 in FIG. 5), and computes target velocities of the hydraulic actuators 15 to 17 at the first future time on the basis of the pilot pressures of the operation devices 51 to 53 taken in (Step S210 in FIG. 5). For example, the target velocities of the hydraulic actuators 15 to 17 are computed by referring to a preset characteristics diagram 916*b* depicted in FIG. 5. The characteristics diagram 916*b* depicted in FIG. 5 is set similarly to the characteristics diagram 916*a*. In this case, the velocity/posture predicting section 915 does not predict the posture of the front work implement 1, the position of the control point relative to the target surface, and the velocities of the hydraulic actuators 15 to 17 of the front work implement 1. That is, the velocity command computing section 916 computes a target velocity of the boom cylinder 15 corresponding to a boom-raising pilot pressure or a boom-lowering pilot pressure, computes a target velocity of the arm cylinder 16 corresponding to an arm-crowding pilot pressure or an arm-dumping pilot pressure, and computes a target velocity of the bucket cylinder 17 corresponding to a bucket-crowding pilot pressure or a bucket-dumping pilot pressure.

Finally, the velocity command computing section 916 outputs the target velocities of the hydraulic actuators 15 to 17 at the first future time computed at Step S210, as velocity commands to the hydraulic actuators 15 to 17 at the current time (current computation cycle), to the actuator control section 917 and the hydraulic pump control section 918 (Step S220 in FIG. 5). That is, the MC computing section 91 computes velocity commands that dictate actions of the hydraulic actuators 15 to 17 according to operation of the operation devices 51 to 53. With the end of Step S220, this computation cycle ends, the procedure returns to the start, and the next computation cycle is started.

Figure 7:
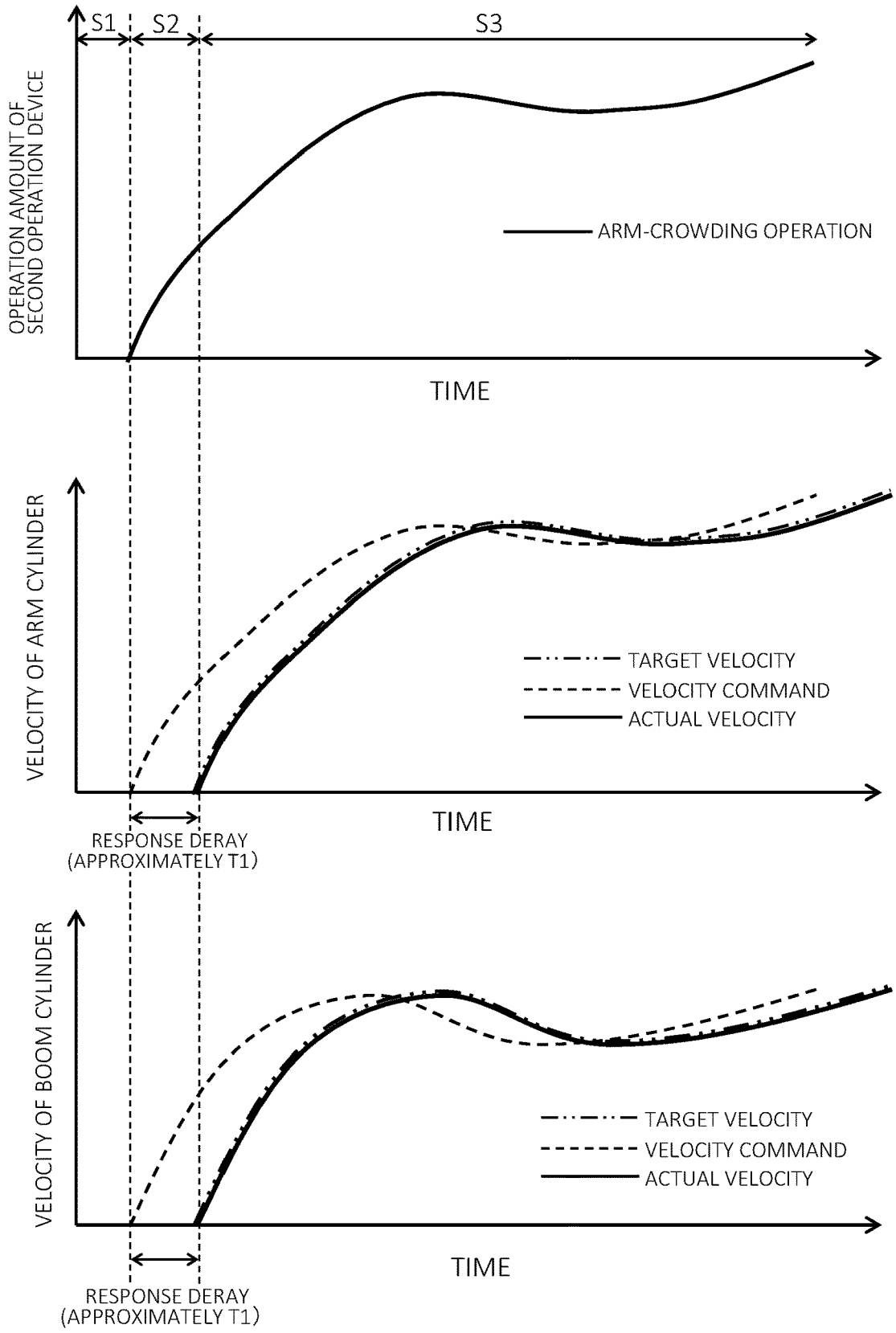
FIG. 7 is an explanatory diagram depicting a relation between a target velocity, a velocity command, and an actual velocity of each hydraulic actuator at the time of MC execution on arm-crowding operation in the work machine according to the first embodiment of the present invention.

Next, actions and advantages of the work machine according to the first embodiment of the present invention are explained by using FIG. 5 and FIG. 7. FIG. 7 is an explanatory diagram depicting a relation between a target velocity, a velocity command, and an actual velocity of each hydraulic actuator during MC execution on arm-crowding operation in the work machine according to the first embodiment of the present invention. In FIG. 7, an upper diagram depicts a temporal history of the operation amount of the second operation device for arm operation, a middle diagram depicts a temporal history of a target velocity, a velocity command, and an actual velocity of the arm cylinder, and a lower diagram depicts a temporal history of a target velocity, a velocity command, and an actual velocity of the boom cylinder.

In the case explained here, input by an operator of arm-crowding operation of the second operation device 52 for arm operation triggers a horizontal excavation action by MC. In this case, the MC switching device 28 has been switched to the position to turn on MC.

In FIG. 7, a first period S1 is a period in which operation of the second operation device 52 by an operator is not being performed. A second period S2 is a period in which operation of the second operation device 52 is being performed, but an action of the arm cylinder is not being performed due to the influence of a delay of response to the operation of the second operation device 52. A third period S3 is a period in which the arm cylinder is performing an action due to the operation of the second operation device 52.

The controller 80 makes a determination of YES at Step S20 in the flowchart depicted in FIG. 5 and executes the processes of Steps S30 to S120.

In the first period S1, operation of the second operation device 52 is not being performed in the first period S1. Because of this, the velocities (actual velocities) of the hydraulic actuators 15 to 17 at the current time as computation results of the velocity/posture predicting section 915 are zero (Step S50 in FIG. 5), and histories of predicted velocity values of the hydraulic actuators 15 to 17 at the first future time (a future time which is the first length of time T1 after the current time) are also zero (Step S60 in FIG. 5). From these computation results of the velocity/posture predicting section 915, predicted values of extension/contraction lengths of the hydraulic actuators 15 to 17 at the first future time (computation results) is zero (Step S70 in FIG. 5), and predicted values of the posture of the front work implement 1 and the position of the control point relative to the target surface at the first future time (computation results) do not change from and are the same value as the posture of the front work implement 1 and the position of the control point relative to the target surface at the current time (current computation cycle) (Step S80 in FIG. 5). Hence, target velocities of the arm cylinder 16 and the boom cylinder 15 as computation results of the velocity command computing section 916 are zero (Steps S90 to S110 in FIG. 5). Accordingly, in the first period S1, the velocity command computing section 916 outputs target velocities of zero as velocity commands at the current time.

In the second period S2, arm-crowding operation of the second operation device 52 is input, so the velocity command computing section 916 computes a target velocity of the arm cylinder 16 at the first future time (Steps S100 to S110 in FIG. 5) on the basis of an arm-crowding pilot pressure according to a sensing signal of the operation amount sensor 78 (fourth pressure sensor 76*b* depicted in FIG. 2), and outputs the computation-result target velocity as a velocity command to the arm cylinder 16 at the current time (current computation cycle) (Step S120 in FIG. 5). That is, in the second period S2, a velocity command to the arm cylinder 16 according to the arm-crowding operation of the second operation device 52 is output. It should be noted that an action of the arm cylinder 16 has not been started due to the influence of a delay of response of the actual velocity of the arm cylinder 16 to the velocity command. Note that, a target velocity of and a velocity command to the bucket cylinder 17 at the first future time are always zero since the third operation device 53 for the bucket operation is not being operated in this explanation.

In addition, the velocities (actual velocities) of the hydraulic actuators 15 to 17 at the current time as computation results of the velocity/posture predicting section 915 are zero (Step S50 in FIG. 5) since an action of the arm cylinder 16 has not been started. On the other hand, since a history of past velocity commands to the arm cylinder 16 output by the velocity command computing section 916 during a period from the first past time (a past time which is the first length of time T1 before the current time) until the current time is not zero in the second period S2 as mentioned above, a history of predicted velocity values of the arm cylinder 16 from the current time until the first future time is computed on the basis of the history of the past velocity commands to the arm cylinder 16 (Step S60 in FIG. 5). From these computation results of the velocity/posture predicting section 915, predicted values of extension/contraction lengths of the hydraulic actuators 15 to 17 at the first future time are computed (Step S70 in FIG. 5), and predicted values of the posture of the front work implement 1 and the position of the control point relative to the target surface at the first future time are computed (Step S80 in FIG. 5).

Based on these predicted values, the velocity command computing section 916 computes a target velocity of the boom cylinder 15 at the first future time that satisfies the predetermined condition (Step S90 in FIG. 5). The computation-result target velocity of the boom cylinder 15 at the first future time is output as a velocity command at the current time (current computation cycle) (Step S120 in FIG. 5). That is, even when the first operation device 51 for boom-operation is not operated, a command for a forced action of the boom cylinder 15 that satisfies the predetermined condition is generated. Note that the history of the velocity commands to the boom cylinder 15 output from the velocity command computing section 916 in the second period S2 is used for computing a predicted velocity value of the boom cylinder 15, a predicted value of an extension/contraction length of the boom cylinder 15, and predicted values of the posture of the front work implement 1 and the position of the control point relative to the target surface at the first future time.

In this manner, in the second period S2, the arm cylinder 16 has not started an action due to the influence of a delay of response to arm-crowding operation of the second operation device 52. However, in the present embodiment, by predicting actions of the hydraulic actuators 15 to 17 at the first future time which is the first length of time T1 after the computation cycle on the basis of histories of past velocity commands to the hydraulic actuators 15 to 17 computed and output in the second period S2, it becomes possible to output a velocity command to the boom cylinder 15 at the current time (current computation cycle) taking into consideration delays of response of the actual velocities of the hydraulic actuators 15 to 17 to velocity commands. That is, when the second operation device 52 is operated, the controller 80 outputs in advance a velocity command to the boom cylinder 15 corresponding to a predicted action of the arm cylinder 16 even before the arm cylinder 16 starts an actual action. Thus, execution of MC taking into consideration delays of response of the hydraulic actuators 15 to 17 can be realized.

In the third period S3, the arm-crowding operation of the second operation device 52 is continued, and also a length of time corresponding to a response delay (nearly equal to the first length of time T1) has elapsed since the start of the arm-crowding operation. Because of this, the arm cylinder 16 is performing an action according to the arm-crowding operation with the response delay.

In this case, similarly to the case of the second period S2, the velocity command computing section 916 computes a target velocity of the arm cylinder 16 at the first future time according to the arm-crowding operation, and outputs the computation-result target velocity as a velocity command to the arm cylinder 16 at the current time (current computation cycle) (Steps S100 to 120 in FIG. 5).

In addition, since the arm cylinder 16 and the boom cylinder 15 are performing actions unlike the case of the second period S2, the velocity/posture predicting section 915 computes the velocities (which are not zero) of the hydraulic actuators 15 to 17 at the current time (Step S50 in FIG. 5). Further, histories of predicted velocity values of the hydraulic actuators 15 to 17 are computed on the basis of the computation-result velocities of the hydraulic actuators 15 to 17 at the current time and histories of past velocity commands to the hydraulic actuators 15 to 17 output by the velocity command computing section 916 (Step S60 in FIG. 5). From these computation results of the velocity/posture predicting section 915, predicted values of extension/contraction lengths of the hydraulic actuators 15 to 17 at the first future time are computed (Step S70 in FIG. 5), and predicted values of the posture of the front work implement 1 and the position of the control point relative to the target surface at the first future time are computed (Step S80 in FIG. 5). That is, unlike the case of the second period S2, predictive computation of the velocity/posture predicting section 915 reflects also the influence of the actual actions (actual velocities) of the hydraulic actuators 15 to 17.

Similarly to the case of the second period S2, on the basis of the predicted values (computation results) of the velocity/posture predicting section 915, the velocity command computing section 916 computes a target velocity of the boom cylinder 15 at the first future time that satisfies the predetermined condition (Step S90 in FIG. 5), and outputs the computation-result target velocity of the boom cylinder 15 at the first future time as a velocity command at the current time (current computation cycle) (Step S120 in FIG. 5). In this case, a command for a forced action of the boom cylinder 15 reflecting the influence of the actual actions (actual velocities) of the hydraulic actuators 15 to 17 is generated.

In this manner, in the third period S3, actions of the hydraulic actuators 15 to 17 at the first future time are predicted on the basis of the velocities (actual velocities) of the hydraulic actuators 15 to 17 at the current time (current computation cycle) and a history of past velocity commands to the arm cylinder 16. Thus, it becomes possible to output a velocity command to the boom cylinder 15 at the current time (current computation cycle) taking into consideration delays of response of the actual velocities of the hydraulic actuators 15 to 17 to velocity commands. That is, when the second operation device 52 is operated and the arm cylinder 16 is performing an actual action, the controller 80 outputs in advance a velocity command to the boom cylinder 15 corresponding to a predicted action of the arm cylinder 16. Thus, execution of MC taking into consideration delays of response of the hydraulic actuators 15 to 17 can be realized.

In this manner, in the present embodiment, in the second period S2 and the third period S3 in which the second operation device 52 is being operated, actions of the hydraulic cylinders 15 to 17 at the first future time are predicted. It is possible to compute and output a velocity command to the boom cylinder 15 taking into consideration response delays of the hydraulic cylinders 15 to 17. Accordingly, when MC to control an action of the boom cylinder 15 is executed in response to an action of the arm cylinder 16 under the predetermined condition, it is possible to reduce the influence of delays of response of the actual velocities of the hydraulic cylinders to velocity commands.

As mentioned above, the hydraulic excavator (work machine) according to the first embodiment of the present invention includes: the front work implement 1 (work implement) that performs work; the boom cylinder 15, the arm cylinder 16, and the bucket cylinder 17 (plurality of hydraulic actuators) that drive the front work implement 1 (work implement); the hydraulic pump 42 that supplies the hydraulic fluid to the boom cylinder 15, the arm cylinder 16, and the bucket cylinder 17 (plurality of hydraulic actuators); the first flow rate control valve 45, the second flow rate control valve 46, and the third flow rate control valve 47 (plurality of control valves) that each control the flow of the hydraulic fluid supplied from the hydraulic pump 42 to a corresponding one of the boom cylinder 15, the arm cylinder 16, and the bucket cylinder 17 (plurality of hydraulic actuators); the posture sensor 30 that senses the posture of the front work implement 1 (work implement); and the controller 80 configured to compute a velocity command to each of the boom cylinder 15, the arm cylinder 16, and the bucket cylinder 17 (plurality of hydraulic actuators) at each computation cycle and output a control signal for controlling each of the boom cylinder 15, the arm cylinder 16, and the bucket cylinder 17 (plurality of hydraulic actuators) on the basis of the computation-result velocity command to each of the boom cylinder 15, the arm cylinder 16, and the bucket cylinder 17 (plurality of hydraulic actuators). In a case where the controller 80 controls an action of the boom cylinder 15 (first hydraulic actuator) according to an action of the arm cylinder 16 (second hydraulic actuator) in the plurality of hydraulic actuators 15, 16, and 17 under a predetermined condition, the controller 80 computes the actual velocity of each of the plurality of hydraulic actuators at the current computation cycle on the basis of a sensing signal of the posture sensor 30, computes a velocity command to the boom cylinder 15 (first hydraulic actuator) at the current computation cycle such that the velocity command satisfies the condition, with use of the computation-result actual velocity of each of the plurality of hydraulic actuators 15, 16, and 17 and a history of past velocity commands to each of the plurality of hydraulic actuators 15, 16, and 17 computed at previous computation cycles before the current computation cycle, and outputs a control signal for controlling the boom cylinder 15 (first hydraulic actuator) on the basis of the computation-result velocity command to the boom cylinder 15 (first hydraulic actuator) at the current computation cycle.

According to this configuration, since the velocity command to the boom cylinder 15 (first hydraulic actuator) at the current computation cycle that satisfies the predetermined condition is computed with use of the actual velocity of each hydraulic actuator 15, 16, or 17 at the current computation cycle computed on the basis of the sensing signal of the posture sensor 30 and the history of the past velocity commands to each hydraulic actuator 15, 16, or 17 computed at the previous computation cycles before the current computation cycle, it is possible to compute the velocity command to the boom cylinder 15 (first hydraulic actuator) taking into consideration delays of response of the actual velocities to velocity commands. Accordingly, it is possible to reduce the influence of delays of response of the actual velocities of the hydraulic actuators 15, 16, and 17 to velocity commands and enhance the action accuracy of the front work implement 1 (work implement) in MC.

In addition, the controller 80 according to the present embodiment is configured to: compute a predicted velocity value of each of the plurality of hydraulic actuators 15, 16, and 17, a predicted posture value of the front work implement 1 (work implement), and a predicted position value of the control point of the front work implement 1 (work implement) relative to the target surface at the time which is the predetermined first length of time T1 after the current computation cycle, with use of the actual velocity of each of the plurality of hydraulic actuators 15, 16, and 17 of the current computation cycle based on a sensing signal of the posture sensor 30, and a history of past velocity commands to each of the plurality of hydraulic actuators 15, 16, and 17 computed during a period from a previous computation cycle which is the first length of time T1 before the current computation cycle until the current computation cycle; compute, as the velocity command to the boom cylinder 15 (first hydraulic actuator) at the current computation cycle, such a target velocity of the first hydraulic actuator that the control point of the front work implement 1 (work implement) will be positioned on the target surface at the time which is the first length of time T1 after the current computation cycle, on the basis of the computation-result predicted velocity values, predicted posture value, and predicted position value; and output a control signal for controlling the boom cylinder 15 (first hydraulic actuator) on the basis of the computation-result velocity command to the boom cylinder 15 (first hydraulic actuator) at the current computation cycle.

According to this configuration, various types of predicted value at the time which is the first length of time T1 after the current computation cycle are computed with use of the histories of the past velocity commands to the hydraulic actuators 15, 16, and 17 computed during the period from the previous computation cycle which is the first length of time T1 before the current computation cycle until the current computation cycle. Hence, various types of predicted value taking into consideration delays of response of the actual velocities of the hydraulic actuators 15, 16, and 17 to velocity commands can be obtained by setting the first length of time T1 such that it generally matches a length of time of the delays of response of the actual velocities to the velocity commands. Further, on the basis of the various types of predicted value taking into consideration the delays of response of the actual velocities to the velocity commands, such a target velocity of the boom cylinder 15 (first hydraulic actuator) that the control point of the front work implement 1 (work implement) will be positioned on the target surface at the time which is the first length of time T1 after the current computation cycle is computed as a velocity command at the current computation cycle. Therefore, a velocity command to the boom cylinder 15 (first hydraulic actuator) that satisfies the predetermined condition while taking into consideration the delays of response of the actual velocities to the velocity commands can be obtained. These can reduce the influence of the delays of response of the actual velocities of the hydraulic actuators 15, 16, and 17 to the velocity commands in MC. Accordingly, it becomes possible to enhance the action accuracy of the front work implement 1 (work implement) and to cause the control point of the front work implement 1 (work implement) to move on and along the target surface.

Second Embodiment

Figure 8:
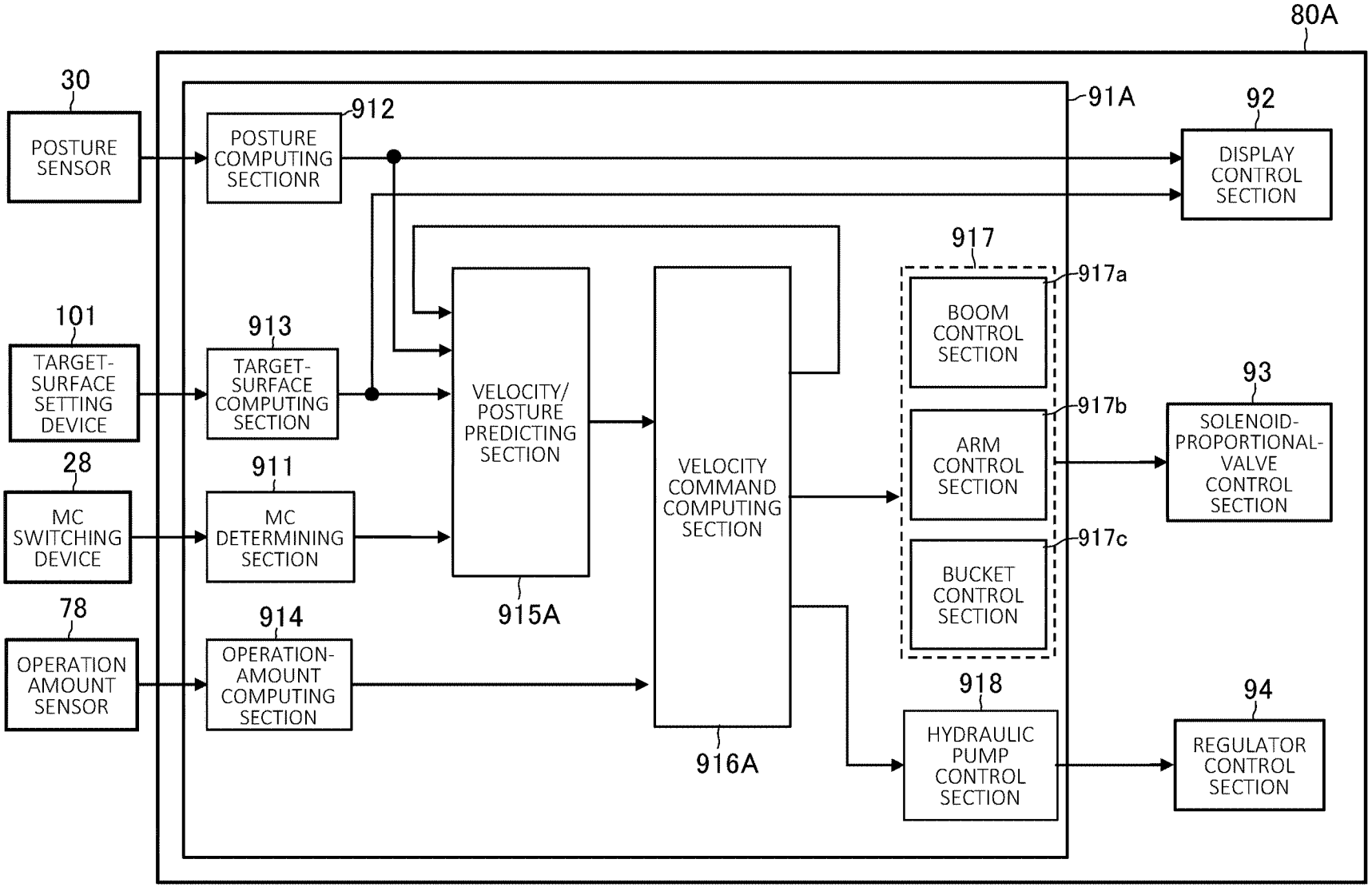
FIG. 8 is a block diagram depicting functionalities of an MC computing section in a controller included as part of a work machine according to a second embodiment of the present invention.
Figure 9:
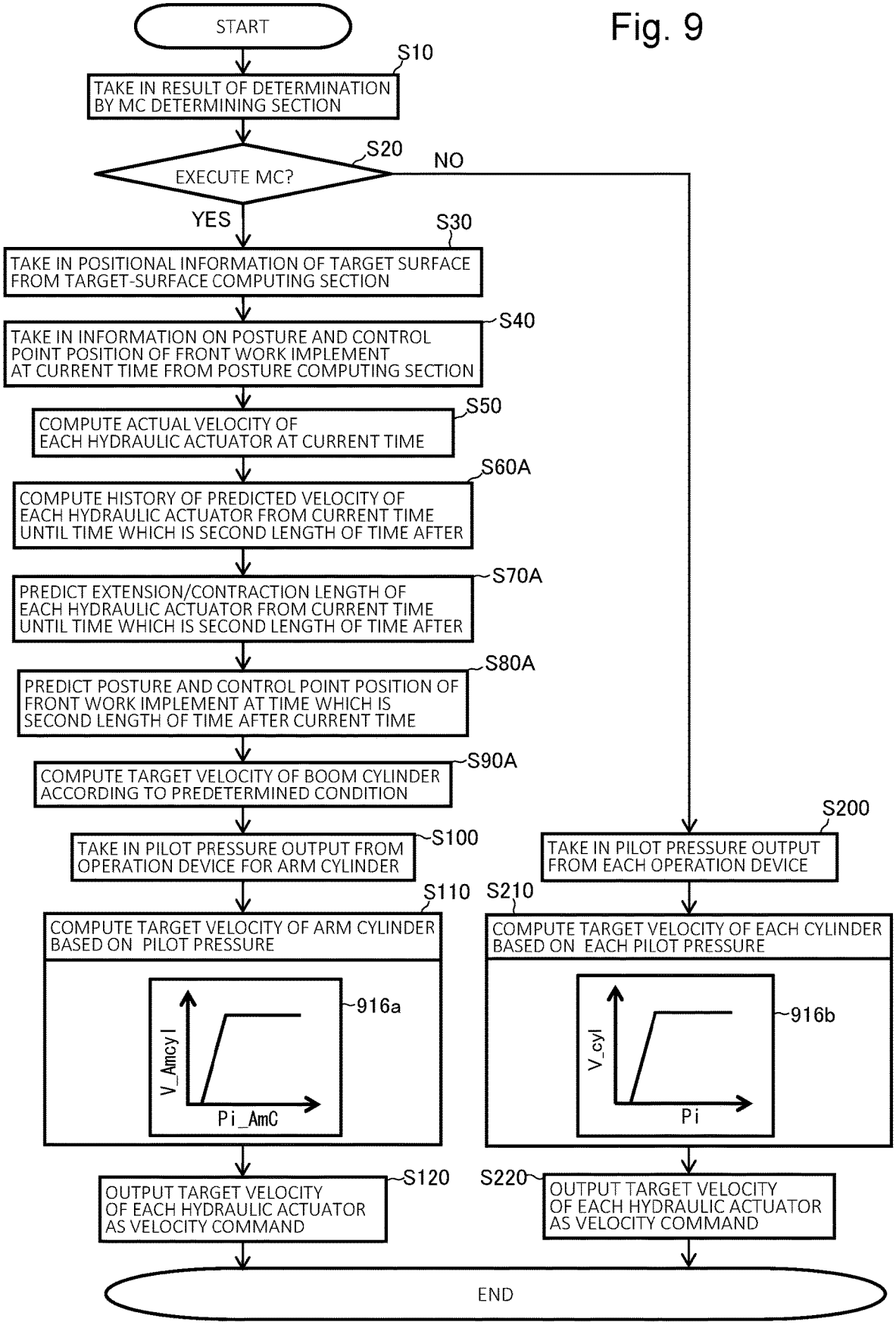
FIG. 9 is a flowchart depicting an example of a procedure of computation in a velocity/posture predicting section and a velocity command computing section in the controller depicted in FIG. 8.
Figure 10:
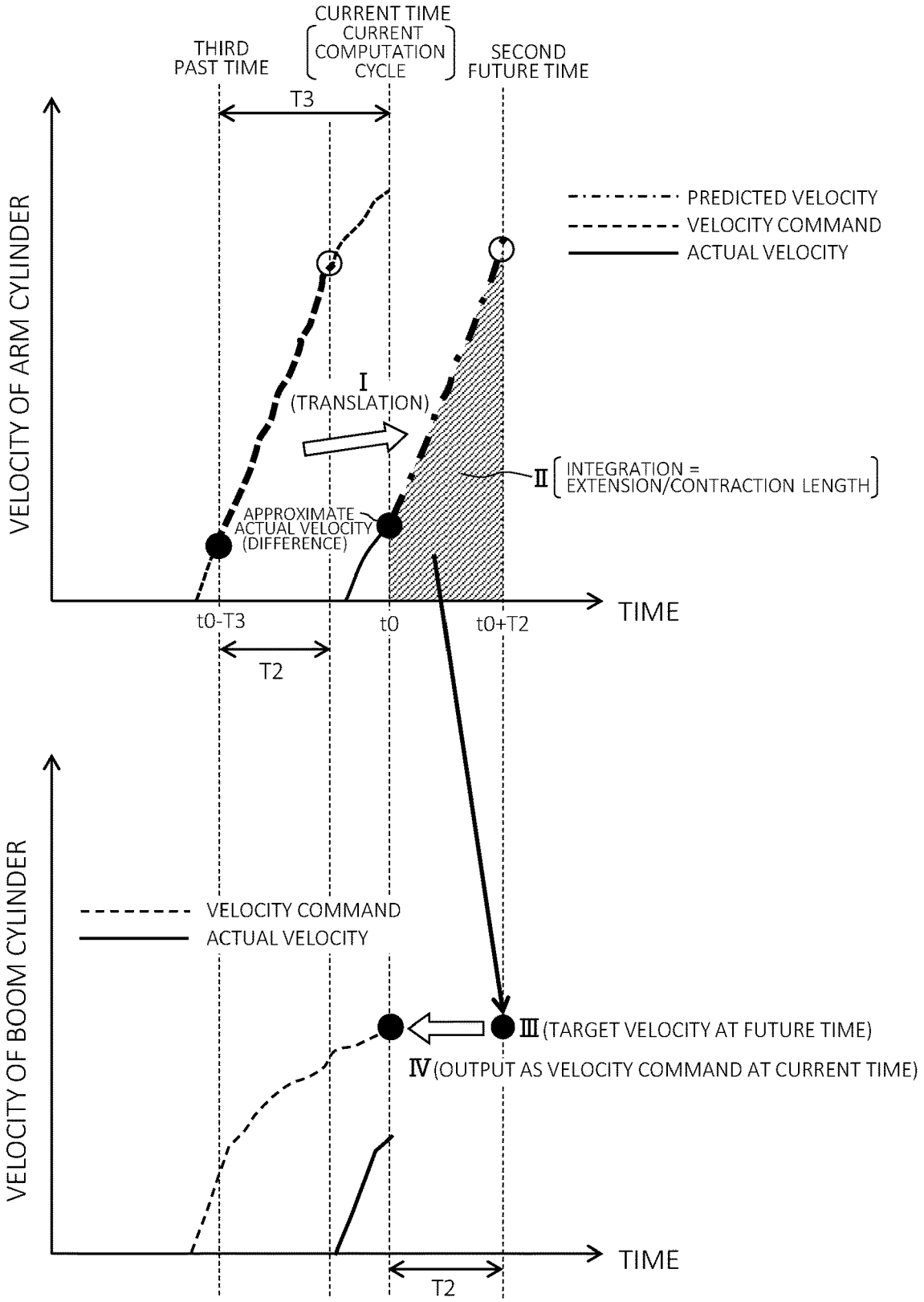
FIG. 10 is an explanatory diagram depicting a computation method of the velocity/posture predicting section and the velocity command computing section in the controller depicted in FIG. 8.
Figure 11:
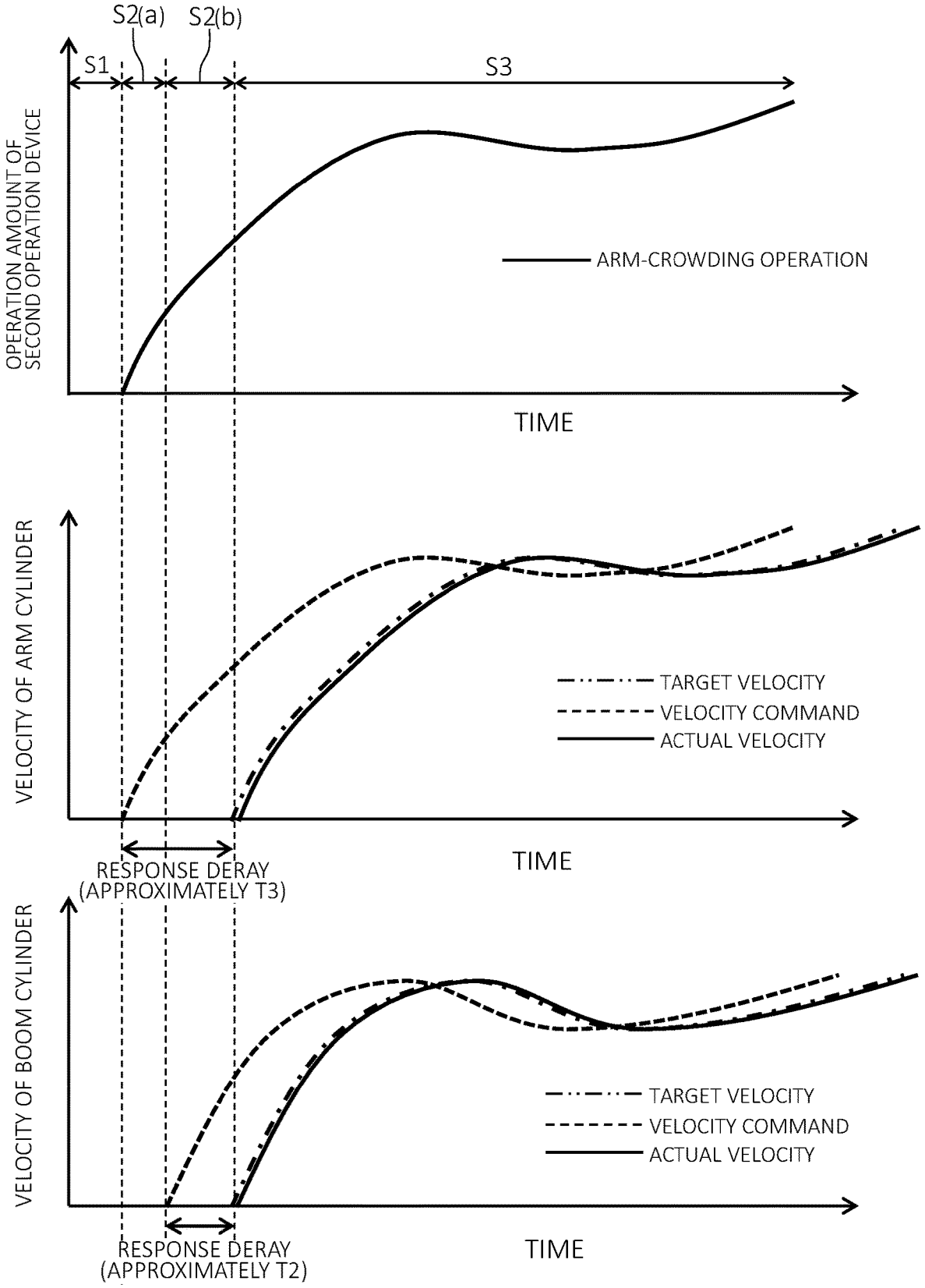
FIG. 11 is an explanatory diagram depicting a relation between a target velocity, a velocity command, and an actual velocity of each hydraulic actuator at the time of MC execution on arm-crowding operation in the work machine according to the second embodiment of the present invention.

Next, a work machine according to a second embodiment of the present invention is explained by using FIG. 8 to FIG. 11. FIG. 8 is a block diagram depicting functionalities of an MC computing section in a controller included as part of the work machine according to the second embodiment of the present invention. FIG. 9 is a flowchart depicting an example of a procedure of computation in a velocity/posture predicting section and a velocity command computing section in the controller depicted in FIG. 8. FIG. 10 is an explanatory diagram depicting a computation method of the velocity/posture predicting section and the velocity command computing section in the controller depicted in FIG. 8. FIG. 11 is an explanatory diagram depicting a relation between a target velocity, a velocity command, and an actual velocity of each hydraulic actuator during MC execution on arm-crowding operation in the work machine according to the second embodiment of the present invention. Note that portions in FIG. 8 to FIG. 11 that are given the same reference characters as reference characters of their counterparts depicted in FIG. 1 to FIG. 7 are similar portions, and hence, detailed explanations thereof are omitted.

The second embodiment of the work machine according to the present invention depicted in FIG. 8 is different from the first embodiment in that a velocity/posture predicting section 915A and a velocity command computing section 916A in an MC computing section 91A in a controller 80A use a different computation method. The velocity/posture predicting section 915 and the velocity command computing section 916 in the MC computing section 91 in the controller 80 according to the first embodiment perform computation on the premise that the lengths of time of delays of response of the actual velocities of the hydraulic actuators 15 to 17 to velocity commands are generally the first length of time T1. In contrast, the velocity/posture predicting section 915A and the velocity command computing section 916A according to the present embodiment perform computation on the premise that the length of time of a delay of response of the actual velocity of the boom cylinder 15 to a velocity command is generally a second length of time T2, and also the length of time of a delay of response of the actual velocity of the arm cylinder 16 to a velocity command is generally a third length of time T3. It should be noted that the present embodiment is applied to only a limited case where the third length of time T3 is longer than the second length of time T2.

The velocity/posture predicting section 915A according to the present embodiment computes predicted velocity values of the hydraulic actuators 15 to 17 of the front work implement 1, a predicted posture value of the front work implement 1, and a predicted position value of the control point relative to the target surface at a future time (hereinafter, referred to as a second future time in some cases) which is the second length of time T2 after the current time (current computation cycle). Specifically, the predicted values described above at the second future time are computed on the basis of the posture and control point position of the front work implement 1 at the current time (current computation cycle) as computation results of the posture computing section 912, positional information of the target surface as a computation result of the target-surface computing section 913, a history of past velocity commands to the boom cylinder 15 computed by and output from the velocity command computing section 916A during a period from a past time (hereinafter, referred to as a second past time in some cases) which is the second length of time T2 before the current time (current computation cycle) until the current time (current computation cycle), and histories of past velocity commands to the arm cylinder 16 and the bucket cylinder 17 (hydraulic actuators of the front work implement 1 other than the boom cylinder 15) computed by and output from the velocity command computing section 916A during a period from a past time (hereinafter, referred to as a third past time in some cases) which is the third length of time T3 before the current time (current computation cycle) until a past time which is the second length of time T2 after the third past time. A detailed computation method of the velocity/posture predicting section 915A is mentioned later.

When the result of determination by the MC determining section 911 is to turn on MC, the velocity command computing section 916A computes, as a target velocity, such a velocity of the boom cylinder 15 (boom 11) to be required at the second future time which is the second length of time T2 after the current time (current computation cycle) that the control point of the front work implement 1 (e.g., the claw tip of the bucket 13) will be positioned on the target surface at the second future time. In addition, the velocity command computing section 916A computes target velocities of the arm cylinder 16 (arm 12) and the bucket cylinder 17 (bucket 13) at a future time (hereinafter, referred to as a third future time in some cases) which is the third length of time T3 after the current time (current computation cycle). Specifically, on the basis of the predicted velocity values of the hydraulic actuators 15 to 17, the predicted posture value of the front work implement 1, and the predicted position value of the control point relative to the target surface as computation results of the velocity/posture predicting section 915A, the velocity command computing section 916A computes a target velocity of the boom cylinder 15 that satisfies the condition described above at the second future time. In addition, the velocity command computing section 916A computes target velocities of the arm cylinder 16 and the bucket cylinder 17 at the third future time based on the operation amounts of the operation devices 52 and 53 as sensing results of the operation amount sensor 78. The velocity command computing section 916A outputs the computation-result target velocities of the hydraulic actuators 15 to 17 as velocity commands at the current time (current computation cycle).

Next, an example of details of the computation method of the velocity/posture predicting section and the velocity command computing section of the controller in the work machine according to the second embodiment of the present invention is explained by using FIG. 9 and FIG. 10. The flowchart in FIG. 9 depicts one computation cycle. In FIG. 10, an upper diagram depicts information on the velocity of the arm cylinder, and a lower diagram depicts information on the velocity of the boom cylinder. In addition, solid lines represent the actual velocities of the hydraulic actuators, broken lines represent velocity commands to the hydraulic actuators, and a dash-dotted line represents a predicted velocity of the hydraulic actuator.

First, similarly to the case of the first embodiment, the velocity/posture predicting section 915A depicted in FIG. 8 determines whether to execute MC, based on a result of determination (as to whether to turn on or turn off MC) by the MC determining section 911 (Steps S10 to S20 in the flowchart depicted in FIG. 9). When the determination result at Step S20 is YES, the processes of Steps S30 to Step S120 including Steps S60A to S90A are executed; on the other hand, when the determination result at Step S20 is NO, the processes of Steps S200 to Step S220 similar to those of the first embodiment are executed.

When the determination result at Step S20 is YES, similarly to the case of the first embodiment, the velocity/posture predicting section 915A takes in positional information of the target surface from the target-surface computing section 913 (Step S30 in FIG. 9). Further, the velocity/posture predicting section 915A takes in the posture and control point position of the front work implement 1 at the current time from the posture computing section 912, and computes the actual velocities of the hydraulic actuators 15 to 17 at the current time (current computation cycle) based on the information taken in (Steps S40 to S50 in FIG. 9). The computation of the actual velocities is equivalent to a black dot at the current time (current computation cycle) in the upper diagram of FIG. 10. It should be noted that only a case of the arm cylinder 16 is depicted in FIG. 10.

Next, the velocity/posture predicting section 915A computes histories of predicted velocity values of the hydraulic actuators 15 to 17 from the current time (current computation cycle) until the future time (second future time) which is the second length of time T2 after (Step S60A in FIG. 9). Specifically, a history of past velocity commands to the arm cylinder 16 computed and output by the velocity command computing section 916A during a period from the past time (third past time) which is the third length of time T3 before the current time (current computation cycle) until a past current time (previous computation cycle) which is the second length of time T2 after the past time (third past time) is translated toward the velocity (actual velocity) of the arm cylinder 16 at the current time computed at Step S50, and a velocity command to the arm cylinder 16 output by the velocity command computing section 916A at the third past time is caused to match the velocity (actual velocity) of the arm cylinder 16 at the current time computed at Step S50. This translated history of the past velocity commands to the arm cylinder 16 is regarded as a history of predicted velocity values of the arm cylinder 16 from the current time until the second future time. That is, a history of future velocities of the arm cylinder 16 in a time interval from the current time until the second future time is predicted on the basis of the history of the past velocity commands to the arm cylinder 16 output from the velocity command computing section 916A during the period from the third past time until the past time which is the second length of time T2 after the third past time, with the velocity (actual velocity) of the arm cylinder 16 at the current time regarded as a reference velocity.

This computation is equivalent to I (translation) depicted in FIG. 10. That is, this computation is equivalent to translating the broken line (velocity commands to the hydraulic actuators 15 to 17) from the third past time (t0−T3) until the past time which is the second length of time T2 after the third past time (t0−T3+T2) in such a manner that the black dot of the velocity command of the third past time (t0−T3) matches the black dot of the actual velocity at the current time (t0), thereby generating the dash-dotted line (predicted velocity values of the hydraulic actuators 15 to 17) from the current time (t0) until the second future time (t0+T2) in the upper diagram of FIG. 10.

Note that computation of a history of a predicted velocity value of the boom cylinder 15 is similar to the computation method in the case of the first embodiment but is different in that the set length of time is changed from the first length of time T1 to the second length of time T2. That is, a history of future velocities of the boom cylinder 15 in the time interval from the current time until the second future time is predicted on the basis of the history of the past velocity commands to the boom cylinder 15 output from the velocity command computing section 916A during the period from the past time (second past time) which is the second length of time T2 before the current time (current computation cycle) until the current time (current computation cycle), with the velocity (actual velocity) of the boom cylinder 15 at the current time regarded as a reference velocity. Referring to FIG. 6 used for the explanation of the first embodiment, it is different in that the first length of time T1 in FIG. 6 is changed to the second length of time T2. That is, with the current time (current computation cycle) t0 regarded as a reference time, the first future time (t0+T1) is changed to the second future time (t0+T2), and also the first past time (t0−T1) is changed to the second past time (t0−T2). This is for taking into consideration the fact that, while a velocity command to the boom cylinder 15 is generally achieved as the actual velocity with a response delay of the second length of time T2, a velocity command to the arm cylinder 16 is generally achieved as the actual velocity with a response delay of the third length of time T3.

Next, the velocity/posture predicting section 915A predicts extension/contraction lengths of the hydraulic actuators 15 to 17 that are produced during a period from the current time until the second future time (Step S70A in FIG. 9). Specifically, the velocity/posture predicting section 915A integrates, over the time interval from the current time until the second future time, the histories of the predicted velocity values of the hydraulic actuators 15 to 17 from the current time until the second future time computed at Step S60A to predict extension/contraction lengths of the hydraulic actuators 15 to 17 that are produced during the period from the current time until the second future time.

This predictive computation is equivalent to II (integration=extension/contraction length) depicted in FIG. 10. That is, in the upper diagram of FIG. 10, the area size of a shaded portion surrounded by the time interval from the current time (t0) until the second future time (t0+T2) and the dash-dotted line (histories of the predicted velocity values of the hydraulic actuators 15 to 17) is equivalent to the predicted values of the extension/contraction lengths of the hydraulic actuators 15 to 17. It should be noted that only a case of the arm cylinder 16 is depicted in FIG. 10. That is, computation equivalent to II (integration=extension/contraction length) depicted in FIG. 10 is performed also for predicted values of the extension/contraction lengths of the boom cylinder 15 and the bucket cylinder 17.

Further, the velocity/posture predicting section 915A predicts the posture of the front work implement 1 and the position of the control point relative to the target surface at the second future time (Step S80A in FIG. 9). Specifically, the posture of the front work implement 1 and the position of the control point relative to the target surface (e.g., the distance from the control point to the target surface) at the second future time are computed on the basis of the posture of the front work implement 1 (postures of the boom 11, the arm 12, and the bucket 13) and the position of the control point at the current time taken in at Step S40, the predicted values of the extension/contraction lengths of the hydraulic actuators 15 to 17 at the second future time computed at Step S70A, and the positional information of the target surface taken in at Step S30. The velocity/posture predicting section 915A outputs, to the velocity command computing section 916A, the posture of the front work implement 1 and the position of the control point relative to the target surface at the second future time as computation results of Step S80A, and the predicted velocity values of the hydraulic actuators 15 to 17 at the second future time as computation results of Step S60A.

Next, the velocity command computing section 916A computes a target velocity of the boom cylinder 15 necessary for satisfying the predetermined condition at the second future time (Step S90A in FIG. 9). Specifically, the velocity command computing section 916A computes such a velocity of the boom cylinder 15 that it becomes possible for the control point of the front work implement 1 to be positioned on the target surface at the second future time, as a target velocity at the second future time, on the basis of the predicted posture value of the front work implement 1 and the predicted position value of the control point relative to the target surface at the second future time computed at Step S80A, and the predicted velocity values of the hydraulic actuators 15 to 17 at the second future time computed at Step S60A, The computation of Steps S60A to S90A in FIG. 9 is equivalent to a process depicted in FIG. 10 from I (translation) to II (integration=extension/contraction length), and from II through an arrow to III (target velocity at future time). This computation is that a command for a forced action of the boom cylinder 15 by activation of MC not according to operation of the operation device 51 under the condition mentioned above is computed according to an action of at least one of the arm cylinder 16 and the bucket cylinder 17 by operation of the operation devices 52 and 53.

Further, similarly to the case of the first embodiment, the velocity command computing section 916A takes in a pilot pressure as an operation amount of the second operation device 52 from the operation-amount computing section 914 (Step S100 in FIG. 9), and computes a target velocity of the arm cylinder 16 at the third future time on the basis of the pilot pressure taken in (Step S110 in FIG. 9). In a case where the third operation device 53 is also operated, a target velocity of the bucket cylinder 17 at the third future time is also computed.

Finally, the velocity command computing section 916A outputs the target velocity of the boom cylinder 15 at the second future time computed at Step S90A as a velocity command to the boom cylinder 15 at the current time (current computation cycle) and also outputs the target velocity of the arm cylinder 16 computed at Step S110 as a velocity command to the arm cylinder 16 at the current time (Step S120 in FIG. 9). The relation between a target velocity and a velocity command of the boom cylinder 15 used at Step S120 is equivalent to a process of a thick white arrow from the black dot of III (target velocity at future time) to the black dot of IV (output as velocity command at current time) depicted in FIG. 10. This is for taking into consideration the fact that a velocity command to the boom cylinder 15 is achieved as the actual velocity of the boom cylinder 15 with a response delay of the second length of time T2 after the velocity command is output. This computation cycle ends with the end of Step S120, the procedure returns to the start, and the next computation cycle is started.

Next, actions and advantages of the work machine according to the second embodiment of the present invention are explained by using FIG. 11. In FIG. 11, an upper diagram depicts a temporal history of the operation amount of the second operation device for arm operation, a middle diagram depicts a temporal history of a target velocity, a velocity command, and an actual velocity of the arm cylinder, and a lower diagram depicts a temporal history of a target velocity, a velocity command, and an actual velocity of the boom cylinder. In the case explained here, similarly to the case of the first embodiment, input of arm-crowding operation of the second operation device 52 for arm operation by an operator triggers a horizontal excavation action by MC.

In FIG. 11, a first period S1 is a period in which operation of the second operation device 52 by an operator is not being performed. A second period S2 is a period in which operation of the second operation device 52 is being performed, but an action of the arm cylinder is not being performed due to the influence of a delay of response to the operation of the second operation device 52. Note that a period S2(*a*) in the second period S2 is a period in which a velocity command to the boom cylinder 15 is zero due to the difference between a length of time of a response delay of the boom cylinder 15 (generally the second length of time T2) and a length of time of a response delay of the arm cylinder 16 (generally the third length of time T3) even if a velocity command to the arm cylinder 16 (with a value which is not zero) is output. On the other hand, a period S2(*b*) in the second period S2 is a period in which a velocity command to the boom cylinder 15 (with a value which is not zero) is output according to output of a velocity command to the arm cylinder 16. A third period S3 is a period in which the arm cylinder 16 is performing an action due to the operation of the second operation device 52. The first period S1 is similar to that of the first embodiment, and hence, an explanation thereof is omitted.

In the second period S2, arm-crowding operation of the second operation device 52 is input. Thereby, on the basis of an arm-crowding pilot pressure according to a sensing signal of the operation amount sensor 78, the velocity command computing section 916A computes a target velocity of the arm cylinder 16 at a time which is the third length of time T3 after (Steps S100 to S110 in FIG. 9). In addition, the velocity/posture predicting section 915A computes the predicted posture value of the front work implement 1, the predicted position value of the control point relative to the target surface, and the predicted velocity values of the hydraulic actuators 15 to 17 at the second future time on the basis of histories of past velocity commands to the hydraulic actuators 15 to 17 output in the past (Steps S60A to S80A in FIG. 9). Based on the predicted values as computation results of the velocity/posture predicting section 915A, the velocity command computing section 916A computes a target velocity of the boom cylinder 15 at the second future time such that the target velocity satisfies the predetermined condition (Step S90A in FIG. 9).

In the present embodiment, the second length of time T2 generally matching the length of time of a response delay of the boom cylinder 15 is shorter than the third length of time T3 generally matching the length of time of a response delay of the arm cylinder 16. A computation result of a target velocity of the boom cylinder 15 at the second future time which is the second length of time T2 after is zero in the period S2(*a*) that is within the second period S2 and corresponds to the difference between the third length of time T3 and the second length of time T2. The velocity command computing section 916A outputs, to the actuator control section 917, a target velocity (with a value which is zero) of the boom cylinder 15 at a time (second future time) which is the second length of time T2 after, as a velocity command to the boom cylinder 15 that should be output at the current time, and a target velocity (with a value according to the operation amount of the operation device 52) of the arm cylinder 16 at a time which is the third length of time T3 after, as a velocity command to the boom cylinder 15. Accordingly, as depicted in FIG. 11, in the period S2(*a*), a velocity command to the arm cylinder 16 is output according to operation of the operation device 52; on the other hand, a velocity command to the boom cylinder 15 is zero.

In the period S2(*b*) within the second period, similarly to the period S2(*a*), on the basis of predicted values at the second future time which is the second length of time T2 after, as computation results of the velocity/posture predicting section 915A, the velocity command computing section 916A computes a target velocity of the boom cylinder 15 at the second future time which is the second length of time T2 after that satisfies the predetermined condition (Step S90A in FIG. 9). In the period S2(*b*), a length of time has elapsed since a velocity command to the arm cylinder 16 according to operation of the operation device 52 is output, and thus, a value which is not zero is computed as a target velocity of the boom cylinder 15 at the second future time which is the second length of time T2 after. The velocity command computing section 916A outputs a target velocity (with a value which is not zero) of the boom cylinder 15 at a time (second future time) which is the second length of time T2 after, as a velocity command to the boom cylinder 15 that should be output at the current time, and a target velocity (with a value according to the operation amount of the operation device 52) of the arm cylinder 16 at a time which is the third length of time T3 after, as a velocity command to the boom cylinder 15. Accordingly, as depicted in FIG. 11, in the period S2(*b*), a velocity command to the arm cylinder 16 is output according to operation of the operation device 52, and also a velocity command to the boom cylinder 15 corresponds to a predicted action taking into consideration a length of time (third length of time T3) of a delay of response of the arm cylinder 16 to the velocity command, while taking into consideration a length of time (second length of time T2) of a response delay of the boom cylinder 15 itself.

In the third period S3, the arm cylinder 16 and the boom cylinder 15 are performing actions according to output of velocity commands. In this case, on the basis of predicted values of the velocities of the hydraulic actuators 15 to 17 at the second future time which is the second length of time T2 after, as computation results of the velocity/posture predicting section 915A taking also into consideration the velocities at the current time, the velocity command computing section 916A computes a target velocity of the boom cylinder 15 at the second future time which is the second length of time T2 after that satisfies the predetermined condition (Step S90A in FIG. 9). Accordingly, in the third period S3, similarly to the case of the period S2(*b*) as depicted in FIG. 11, a velocity command to the arm cylinder 16 is output according to operation of the operation device 52, and also a velocity command to the boom cylinder 15 corresponds to a predicted action taking into consideration a length of time (third length of time T3) of a delay of response of the arm cylinder 16 to the velocity command, while taking into consideration a length of time (second length of time T2) of a response delay of the boom cylinder 15 itself.

In this manner, in the present embodiment, even in a case where a length of time of a response delay of the boom cylinder 15 is different from a length of time of a response delay of the arm cylinder 16, velocity commands to the hydraulic actuators 15 to 17 taking into consideration lengths of time of response delays can be output if the second length of time T2 corresponding to the length of time of a response delay of the boom cylinder 15 is shorter than the third length of time T3 corresponding to the length of time of a response delay of the arm cylinder 16 ((second length of time T2)<(third length of time T3)). Accordingly, the influence of delays of response of the actual velocities of the hydraulic actuators 15 to 17 to target velocities can be reduced.

The controller 80A of the work machine according to the second embodiment of the present invention mentioned above is configured to: compute a predicted velocity value of each of the plurality of hydraulic actuators 15, 16, and 17, a predicted posture value of the work implement, and a predicted position value of the control point of the front work implement 1 (work implement) relative to the target surface at the time which is the second length of time T2 after the current computation cycle, with use of the actual velocity of each of the plurality of hydraulic actuators 15, 16, and 17 at the current computation cycle based on the sensing signal of the posture sensor 30, the history of the past velocity commands to the boom cylinder 15 (first hydraulic actuator) computed during a period from the previous computation cycle which is the predetermined second length of time T2 before the current computation cycle until the current computation cycle, and the history of the past velocity commands to each of the hydraulic actuators 16 and 17 other than the boom cylinder 15 (first hydraulic actuator) computed during a period from the previous computation cycle which is the predetermined third length of time T3 before the current computation cycle until the previous computation cycle which is the second length of time T2 after the previous computation cycle which is the third length of time T3 before the current computation cycle, the third length of time T3 being longer than the second length of time T2; compute, as the velocity command to the boom cylinder 15 (first hydraulic actuator) at the current computation cycle, such a target velocity of the boom cylinder 15 (first hydraulic actuator) that the control point of the front work implement 1 (work implement) will be positioned on the target surface at the time which is the second length of time T2 after the current computation cycle, on the basis of the computation-result predicted velocity values, predicted posture value, and predicted position value; and output a control signal for controlling the boom cylinder 15 (first hydraulic actuator) on the basis of the computation-result velocity command to the boom cylinder 15 (first hydraulic actuator) at the current computation cycle.

According to this configuration, since various types of predicted value at the time which is the second length of time T2 after the current computation cycle are computed with use of the history of the past velocity commands to the boom cylinder 15 (first hydraulic actuator) computed during a period from the previous computation cycle which is the second length of time T2 before the current computation cycle until the current computation cycle, and the histories of the past velocity commands to the arm cylinder 16 and the bucket cylinder 17 (other than the boom cylinder 15) computed during a period from the previous computation cycle which is the third length of time T3 before the current computation cycle until the previous computation cycle which is the second length of time T2 after the previous computation cycle which is the third length of time T3 before the current computation cycle, even in a case where the lengths of time of delays of response of the actual velocities of the boom cylinder 15 (first hydraulic actuator) and the arm cylinder 16 (second hydraulic actuator) to velocity commands are different from each other, various types of predicted value taking into consideration the different delays of response of the hydraulic actuators 15, 16, and 17 can be obtained by setting the second length of time T2 such that it generally matches the length of time of response delay of the boom cylinder 15 (first hydraulic actuator), and also by setting the third length of time T3 such that it generally matches the length of time of response delay of the arm cylinder 16 (second hydraulic actuator). Further, since, on the basis of the various types of predicted value taking into consideration the different delays of response of the hydraulic actuators 15, 16, and 17, such a target velocity of the boom cylinder 15 (first hydraulic actuator) that the control point of the front work implement 1 (work implement) will be positioned on the target surface at the time which is the second length of time T2 after the current computation cycle is computed as a velocity command at the current computation cycle, a velocity command to the boom cylinder 15 (first hydraulic actuator) that satisfies the predetermined condition while taking into consideration the response delay of the boom cylinder 15 (first hydraulic actuator) can be obtained. These can reduce the influence of the different delays of response of the hydraulic actuators 15, 16, and 17 in MC. Accordingly, it becomes possible to enhance the action accuracy of the front work implement 1 (work implement) and to cause the control point of the front work implement 1 (work implement) to move on and along the target surface.

Third Embodiment

Figure 12:
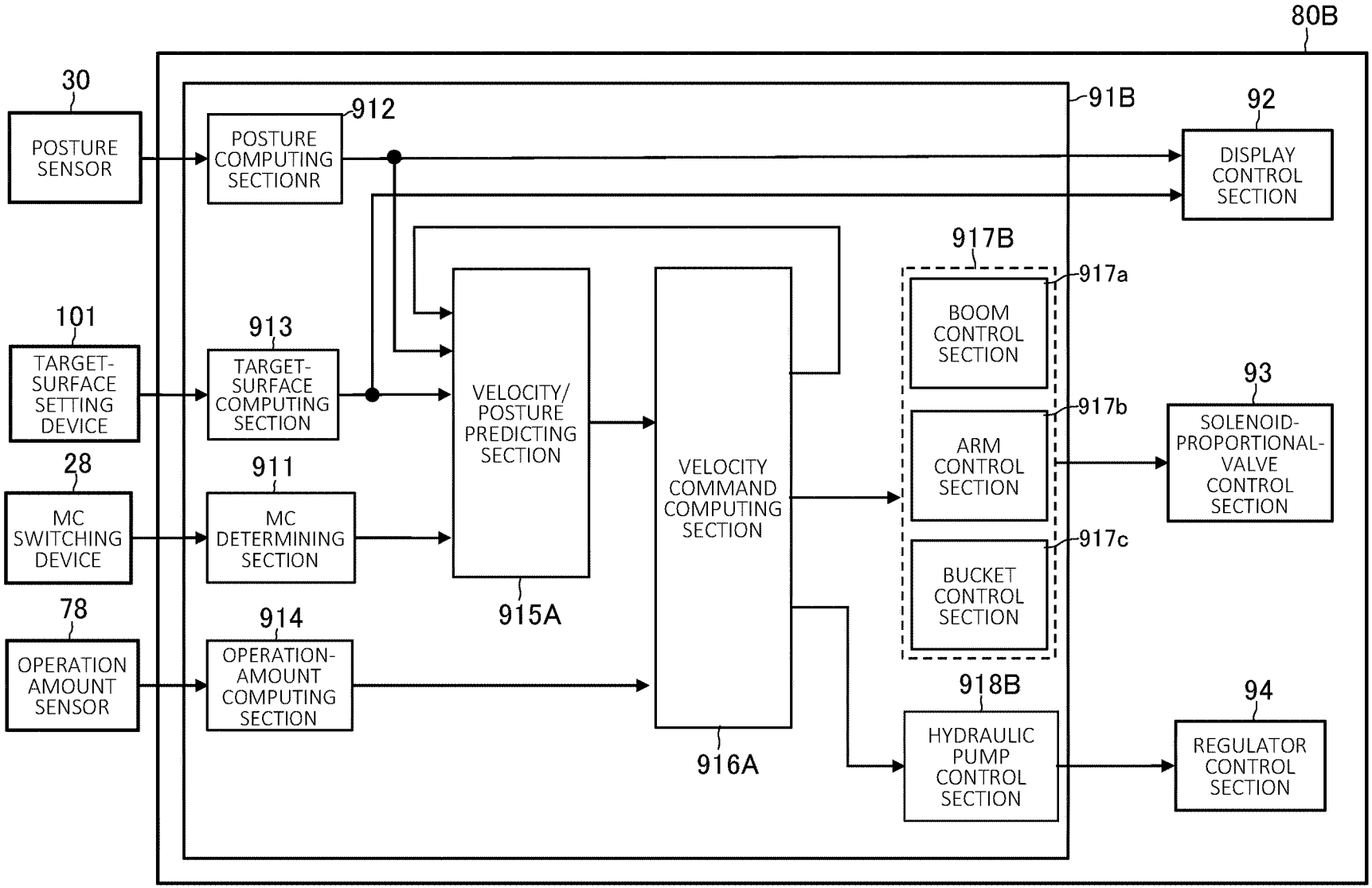
FIG. 12 is a block diagram depicting functionalities of an MC computing section in a controller included as part of a work machine according to a third embodiment of the present invention.

Next, a work machine according to a third embodiment of the present invention is explained by using FIG. 12 to FIG. 15. First, a functional configuration of an MC computing section of a controller in the work machine according to the third embodiment of the present invention is explained by using FIG. 12. FIG. 12 is a block diagram depicting functionalities of the MC computing section in the controller included as part of the work machine according to the third embodiment of the present invention. Note that portions in FIG. 12 that are given the same reference characters as reference characters of their counterparts depicted in FIG. 1 to FIG. 11 are similar portions, and hence, detailed explanations thereof are omitted.

The work machine according to the third embodiment of the present invention depicted in FIG. 12 is different from the second embodiment in that output timings of commands corresponding to computation results of an actuator control section 917B and a hydraulic pump control section 918B in a controller 80B are different. The actuator control section 917 and the hydraulic pump control section 918 in the controller 80 according to the first embodiment output target pilot pressures of the flow rate control valves 45 to 47 and target pump displacement of the hydraulic pump 42 which are computation results at each computation cycle, as pilot pressure commands to the flow rate control valves 45 to 47 and a displacement command to the hydraulic pump 42 at the computation cycle (current time), respectively. In contrast, the actuator control section 917B and the hydraulic pump control section 918B in the controller 80B according to the present embodiment respectively output target pilot pressures of the flow rate control valves 45 to 47 and target pump displacement of the hydraulic pump 42 which are computation results at each computation cycle, as pilot pressure commands to the flow rate control valves 45 to 47 and a pump displacement command to the hydraulic pump 42 with delays, taking into consideration the lengths of time of delays of response of the actual pilot pressures of the flow rate control valves 45 to 47 to pilot pressure commands and the length of time of a delay of response of the actual displacement of the hydraulic pump 42 to a pump displacement command.

Specifically, the actuator control section 917B sets a length of time of a delay on the basis of a fourth length of time T4 generally matching lengths of time of delays of response of the actual pilot pressures of the flow rate control valves 45 to 47 to pilot pressure commands, and outputs target pilot pressures of the flow rate control valves 45 to 47, which are computation results at each computation cycle, as pilot pressure commands to the solenoid-proportional-valve control section 93 after the set delay time length has elapsed. That is, target pilot pressures of the flow rate control valves 45 to 47 that are computed at a previous computation cycle which is the delay time length before the current computation cycle are output as pilot pressure commands at the current time (current computation cycle). For example, the delay time length is a length of time (T3-T4) obtained by subtracting the fourth length of time T4 described above from the third length of time T3 generally matching a length of time of a delay of response of the actual velocity of the arm cylinder 16 to a velocity command. It should be noted that the present embodiment can be applied to only a limited case where the fourth length of time T4 is shorter than the third length of time T3.

In addition, the hydraulic pump control section 918B sets a length of time of a delay on the basis of a fifth length of time T5 generally matching a length of time of a delay of response of the actual displacement of the hydraulic pump 42 to a pump displacement command, and outputs target pump displacement of the hydraulic pump 42, which is a computation result at each computation cycle, as a pump displacement command to the regulator control section 94 after the set delay time length has elapsed. That is, target pump displacement of the hydraulic pump 42 computed in a previous computation cycle which is the delay time length before the current computation cycle is output as a pump displacement command at the current time (current computation cycle). For example, the delay time length is a length of time (T3−T5) obtained by subtracting the fifth length of time T5 described above from the third length of time T3 described above. It should be noted that the present embodiment can be applied to only a limited case where the fifth length of time T5 is shorter than the third length of time T3.

Figure 13:
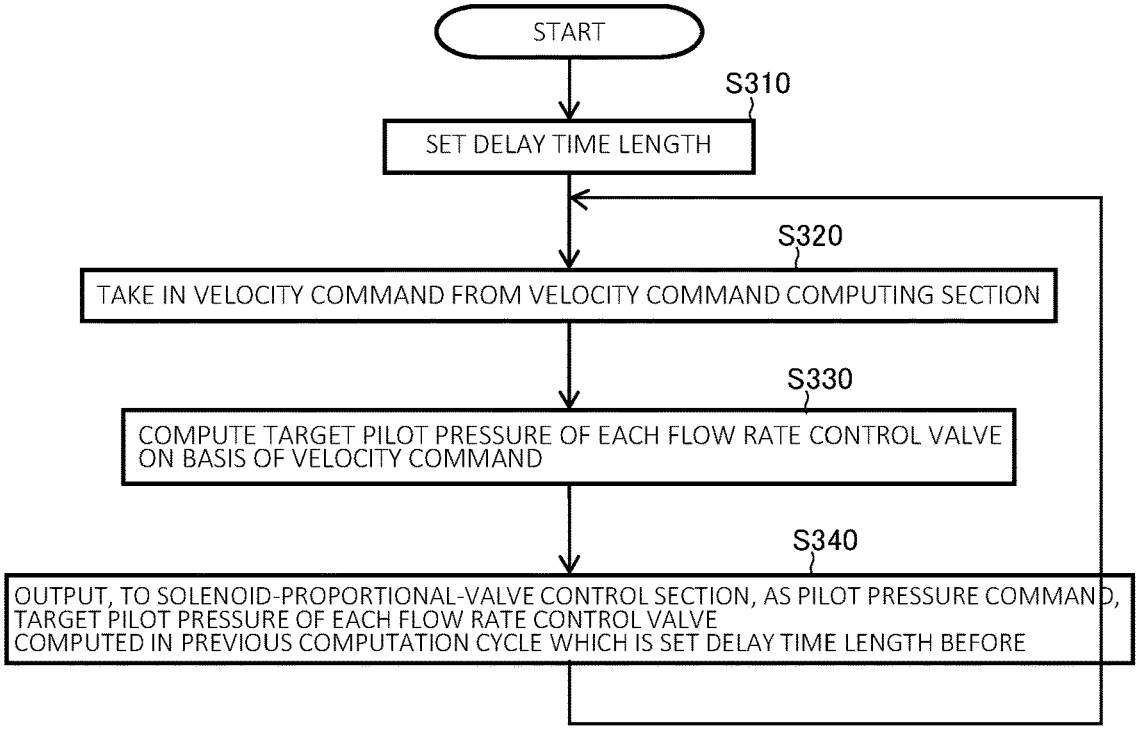
FIG. 13 is a flowchart depicting an example of a procedure of computation in an actuator control section in the controller depicted in FIG. 12.

Next, an example of a procedure of computation in the actuator control section in the controller according to the third embodiment is explained by using FIG. 13. FIG. 13 is a flowchart depicting the example of the procedure of the computation in the actuator control section in the controller depicted in FIG. 12.

First, the actuator control section 917B sets a length of time of a delay of output of a pilot pressure command (Step S310). Specifically, as mentioned above, the delay time length is the length of time (T3−T4) obtained by subtracting the fourth length of time T4 from the third length of time T3. Next, the actuator control section 917B takes in velocity commands to the hydraulic actuators 15 to 17 as computation results of the velocity command computing section 916A (Step S320), and computes target pilot pressures of the flow rate control valves 45 to 47 corresponding to the hydraulic actuators 15 to 17 based on the taken-in velocity commands to the hydraulic actuators 15 to 17 (Step S330). Thereafter, the actuator control section 917B outputs, as pilot pressure commands at the current time, target pilot pressures computed at a previous computation cycle which is the delay time length (T3−T4) set at Step S310 before, to the solenoid-proportional-valve control section 93 (Step S340). With the end of the process of Step S340, the actuator control section 917B performs the processes of Steps S320 to S340 (next computation cycle) again.

Figure 14:
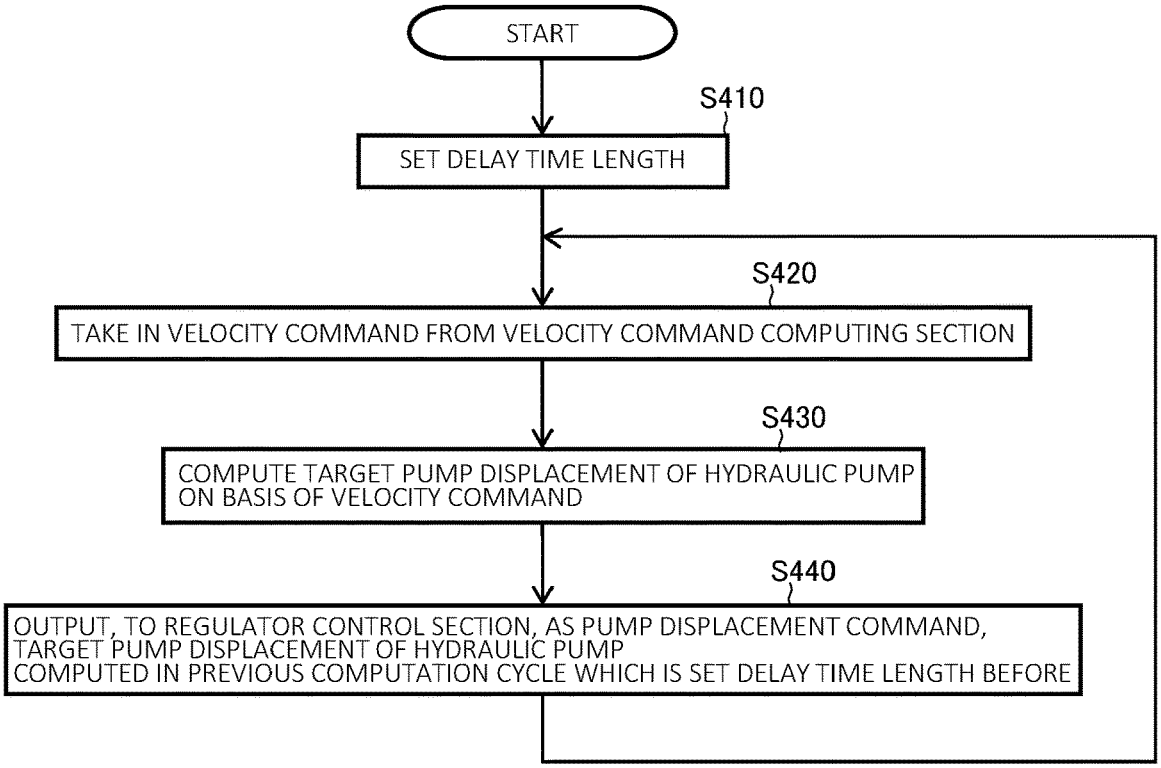
FIG. 14 is a flowchart depicting an example of a procedure of computation in a hydraulic pump control section in the controller depicted in FIG. 12.

Next, an example of a procedure of computation of the hydraulic pump control section in the controller according to the third embodiment is explained by using FIG. 14. FIG. 14 is a flowchart depicting the example of the procedure of the computation by the hydraulic pump control section in the controller depicted in FIG. 12.

First, the hydraulic pump control section 918B sets a length of time of a delay of output of a pump displacement command (Step S410). Specifically, as mentioned above, the delay time length is the length of time (T3−T5) obtained by subtracting the fifth length of time T5 from the third length of time T3. Next, the hydraulic pump control section 918B takes in velocity commands to the hydraulic actuators 15 to 17 as computation results of the velocity command computing section 916A (Step S420), and computes target pump displacement of the hydraulic pump 42 based on the taken-in velocity commands to the hydraulic actuators 15 to 17 (Step S430). Thereafter, the hydraulic pump control section 918B outputs, as a pump displacement command at the current time, target pump displacement computed at a previous computation cycle which is the delay time length (T3−T5) set at Step S410 before, to the regulator control section 94 (Step S440). With the end of the process of Step S440, the hydraulic pump control section 918B performs the processes of Steps S420 to S440 (next computation cycle) again.

Figure 15:
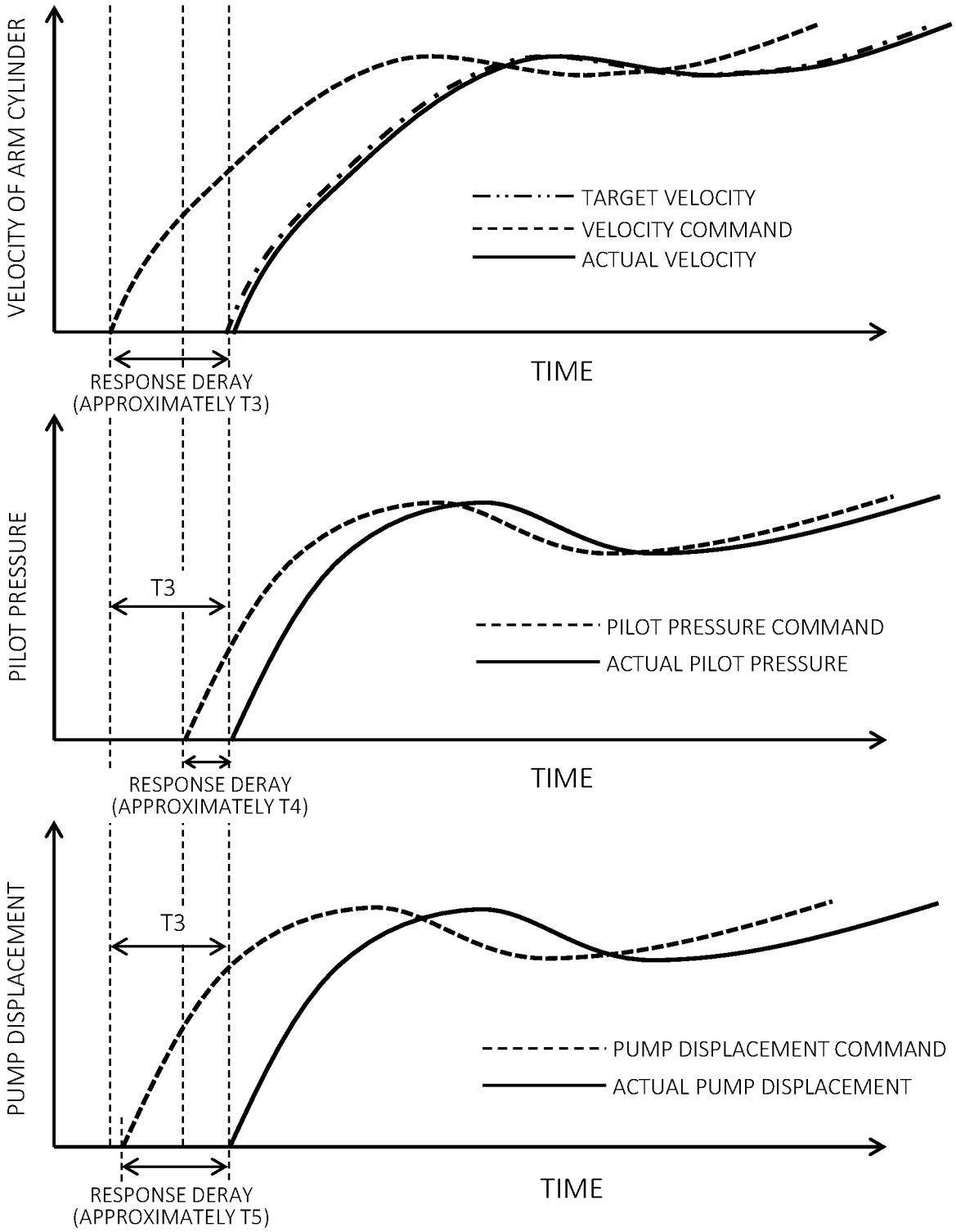
FIG. 15 is an explanatory diagram depicting a relation of control-valve pilot pressure information and hydraulic-pump pump displacement information with hydraulic-actuator velocity information at the time of MC execution in the work machine according to the third embodiment of the present invention.

Next, actions and advantages of the work machine according to the third embodiment of the present invention are explained by using FIG. 15. FIG. 15 is an explanatory diagram depicting a relation of pilot pressure information of the control valve and pump displacement information of the hydraulic pump with velocity information of the hydraulic actuator during MC execution in the work machine according to the third embodiment of the present invention. In FIG. 15, an upper diagram depicts temporal histories of target velocities, velocity commands, and actual velocities of the hydraulic actuators, a middle diagram depicts temporal histories of target pilot pressures and pilot pressure commands of the flow rate control valves, and a lower diagram depicts temporal histories of target pump displacement and a pump displacement command to the hydraulic pump. In the case explained here, similarly to the case of the second embodiment, input of arm-crowding operation of the second operation device 52 for arm operation by an operator triggers a horizontal excavation action by MC.

In FIG. 15, when arm-crowding operation is input, the velocity command computing section 916A computes a target velocity of the arm cylinder 16 at a time which is the third length of time T3 after, based on the operation, and outputs the target velocity as a velocity command at the current time (current computation cycle).

The actuator control section 917B computes a target pilot pressure based on the velocity command at the current time (current computation cycle) which is output of the velocity command computing section 916A, and outputs the computation-result target pilot pressure as a pilot pressure command with a length of time of a delay ((third length of time T3)−(fourth length of time T4)), which is set at S310, from the current time (current computation cycle). That is, as depicted in FIG. 15, the pilot pressure command of the actuator control section 917B is output with the delay time length ((third length of time T3)−(fourth length of time T4)) relative to the output of the velocity command of the velocity command computing section 916A on the basis of which the pilot pressure command has been computed. At this time, pilot pressures to be actually input to the flow rate control valves 45 to 47 change according to pilot pressure commands, and are made approximately match the pilot pressure commands with the delay time length of the fourth length of time T4 relative to the output of the pilot pressure commands.

In addition, the hydraulic pump control section 918B computes target pump displacement based on a velocity command at the current time (current computation cycle) which is output of the velocity command computing section 916A, and outputs the computation-result target pump displacement as a pump displacement command with a length of time of a delay ((third length of time T3)−(fifth length of time T5)), which is set at S410, from the current time (current computation cycle). That is, as depicted in FIG. 15, the pump displacement command of the hydraulic pump control section 918B is output with the delay time length ((third length of time T3)−(fifth length of time T5)) relative to the output of the velocity command of the velocity command computing section 916A on the basis of which the pump displacement command has been computed. At this time, the actual pump displacement of the hydraulic pump 42 changes according to the pump displacement command, and is made approximately match the pump displacement command with the delay time length of the fifth length of time T5 relative to the output of the pump displacement command.

In this manner, in the present embodiment, even in a case where lengths of time of delays of response of the actual pilot pressures of the flow rate control valves 45 to 47 to pilot pressure commands are different from a length of time of a delay of response of the actual pump displacement of the hydraulic pump 42 to a pump displacement command, pilot pressure commands to the flow rate control valves 45 to 47 and a pump displacement command to the hydraulic pump 42 taking into consideration the response delays can be output if the fourth length of time T4 corresponding to the delay time lengths of response of the flow rate control valves 45 to 47 is shorter than the third length of time T3 corresponding to the delay time length of response of the arm cylinder 16, and additionally the fifth length of time T5 corresponding to the delay time length of response of the hydraulic pump 42 is shorter than the third length of time T3 corresponding to the delay time length of response of the arm cylinder 16 ((fourth length of time T4)<(third length of time T3), and additionally (fifth length of time T5)<(third length of time T3)). Because of this, as depicted in the upper diagram of FIG. 15, the influence of delays of response of the actual velocity of the arm cylinder 16 to a velocity command can be reduced.

In the work machine according to the third embodiment of the present invention mentioned above, the plurality of flow rate control valves 45, 46, and 47 (control valves) are hydraulic pilot-type control valves that are driven by effects of pilot pressures. In addition, the controller 80B is configured to compute a target pilot pressure for driving a flow rate control valve 45, 46, or 47 (control valve) corresponding to each of the plurality of hydraulic actuators 15, 16, and 17 according to the computation-result velocity command to each of the plurality of hydraulic actuators 15, 16, and 17, and output the computation-result target pilot pressure as a pilot pressure command with a delay from the current computation cycle. The delay is a length of time obtained by subtracting the predetermined fourth length of time T4 from the third length of time T3, and the fourth length of time T4 is equal to or shorter than the third length of time T3.

According to this configuration, by setting the fourth length of time T4 such that it generally matches lengths of time of delays of response of the actual pilot pressures of the flow rate control valves 45, 46, and 47 (control valves) to pilot pressure commands, it becomes possible to output a pilot pressure command to each flow rate control valve 45 to 47 taking into consideration the delays of response of the flow rate control valves 45 to 47 and a relation between the response delays of the flow rate control valves 45 to 47 and a response delay of the arm cylinder 16. Thus, the influence of the delays of response of the actual velocities of the hydraulic actuators 15, 16, and 17 to velocity commands can be reduced.

In addition, in the present embodiment, the hydraulic pump 42 has the regulator 42*a* that can change pump displacement. The controller 80B is configured to compute target pump displacement of the hydraulic pump 42 according to the computation-result velocity commands to the plurality of hydraulic actuators 15, 16, and 17, and output to the regulator 42*a* the computation-result target pump displacement as a pump displacement command with a delay from the current computation cycle. The delay is a length of time obtained by subtracting the predetermined fifth length of time T5 from the third length of time T3, and the fifth length of time T5 is equal to or shorter than the third length of time T3.

According to this configuration, by setting the fifth length of time T5 such that it generally matches a length of time of a delay of response of the actual pump displacement of the hydraulic pump 42 to a pump displacement command, it becomes possible to output a pump displacement command to the hydraulic pump 42 taking into consideration the response delay of the hydraulic pump 42 and a relation between the response delay of the hydraulic pump 42 and a delay response of the arm cylinder 16. Thus, the influence of delays of response of the actual velocities of the hydraulic actuators 15, 16, and 17 to velocity commands can be reduced.

OTHER EMBODIMENTS

Note that the present invention is not limited to the embodiments mentioned above and includes various modification examples. The embodiments mentioned above are explained in detail for explaining the present invention in an easy-to-understand manner, and the present invention is not necessarily limited to those including all constituent elements explained. It is possible to replace some of the constituent elements of an embodiment with constituent elements of another embodiment, and it is also possible to add constituent elements of an embodiment to the constituent elements of another embodiment. In addition, some of the constituent elements of each embodiment can also have other constituent elements additionally, be deleted, or be replaced.

For example, a hydraulic excavator including the bucket 13 as a work device (attachment) at the tip of the front work implement 1 (work implement) is illustrated as an example in the first to third embodiments mentioned above. However, the present invention can be applied also to hydraulic excavators including an attachment other than the bucket 13, such as a breaker or a magnet. In addition, the present invention can also be applied to various types of work machine other than hydraulic excavators as long as the work machines have an articulated-type work implement formed by coupling a plurality of driven members (boom 11, arm 12, attachment, etc.).

In addition, control to forcibly cause the boom cylinder 15 to perform an action in a case where arm-crowding operation of the second operation device 52 is input by an operator is explained in the embodiments mentioned above. However, the present invention can be applied also to unmanned work machines that perform work with the front work implement 1 not according to operation of an operator. That is, the present invention can be applied to control to forcibly cause at least one of the boom cylinder 15, the arm cylinder 16, and the bucket cylinder 17 to perform an action according to an action of any of the remaining hydraulic cylinders not according to operation of the operation devices 51 to 53 under a predetermined condition.

In addition, in the example depicted in the third embodiment mentioned above, the actuator control section 917B and the hydraulic pump control section 918B of the controller 80B set delay time lengths of command output, on the premise that the length of time of a delay of response of the actual velocity of the boom cylinder 15 to a velocity command is generally the second length of time T2 while the length of time of a delay of response of the actual velocity of the arm cylinder 16 to a velocity command is generally the third length of time T3 (the case of the second embodiment). In contrast, it is also possible to set delay time lengths of command output of the actuator control section 917B and the hydraulic pump control section 918B in the controller 80B, on the premise that the lengths of time of delays of response of the actual velocities of the boom cylinder 15 and the arm cylinder 16 to velocity commands are the same and are generally the first length of time T1 (the case of the first embodiment). In this case, a delay time length set by the actuator control section 917B is a length of time (T1−T4) obtained by subtracting the fourth length of time T4 mentioned above, which generally matches lengths of time of delays of response of the actual pilot pressures of the flow rate control valves 45 to 47 to pilot pressure commands, from the first length of time T1 mentioned above, which generally matches a length of time of a delay of response of the actual velocity of the arm cylinder 16 to a velocity command. In addition, a delay time length set by the hydraulic pump control section 918B is a length of time (T1−T5) obtained by subtracting the fifth length of time T5 mentioned above, which generally matches a length of time of a delay of response of the actual displacement of the hydraulic pump 42 to a pump displacement command, from the first length of time T1 mentioned above. In this case, too, advantages similar to those in the third embodiment can be attained.

DESCRIPTION OF REFERENCE CHARACTERS

1: Front work implement (work implement)
11: Boom
12: Arm
15: Boom cylinder (first hydraulic actuator)
16: Arm cylinder (second hydraulic actuator)
17: Bucket cylinder (hydraulic actuator)
30: Posture sensor
42: Hydraulic pump
42*a*: Regulator
45: First flow rate control valve (control valve)
46: Second flow rate control valve (control valve)
47: Third flow rate control valve (control valve)
80, 80A, 80B: Controller

The invention claimed is:

1. A work machine comprising:
a work implement that performs work;
a plurality of hydraulic actuators that drive the work implement;
a hydraulic pump that supplies a hydraulic fluid to the plurality of hydraulic actuators;
a plurality of control valves that each control a flow of the hydraulic fluid supplied from the hydraulic pump to a corresponding one of the plurality of hydraulic actuators;
a posture sensor that senses a posture of the work implement; and
a controller configured to compute a velocity command to each of the plurality of hydraulic actuators at each computation cycle and output a control signal for controlling each of the plurality of hydraulic actuators on a basis of the computation-result velocity command to each of the plurality of hydraulic actuators,
wherein the controller is configured to:
in a case where an action of a first hydraulic actuator in the plurality of hydraulic actuators is controlled under a predetermined condition according to an action of a second hydraulic actuator,
compute an actual velocity of each of the plurality of hydraulic actuators at a current computation cycle on a basis of a sensing signal of the posture sensor,
compute a velocity command to the first hydraulic actuator at the current computation cycle such that the velocity command satisfies the predetermined condition, with use of predicted velocity values of each of the plurality of hydraulic actuators from the current computation cycle until a predetermined time after the current computation cycle, the predicted velocity values being obtained by regarding the computation-result actual velocity of each of the plurality of hydraulic actuators as a reference and translating to the reference a history of past velocity commands to each of the plurality of hydraulic actuators computed at previous computation cycles before the current computation cycle, and
output a control signal for controlling the first hydraulic actuator on a basis of the computation-result velocity command to the first hydraulic actuator at the current computation cycle.

2. A work machine comprising:
a work implement that performs work;
a plurality of hydraulic actuators that drive the work implement;
a hydraulic pump that supplies a hydraulic fluid to the plurality of hydraulic actuators;
a plurality of control valves that each control a flow of the hydraulic fluid supplied from the hydraulic pump to a corresponding one of the plurality of hydraulic actuators;
a posture sensor that senses a posture of the work implement; and
a controller configured to compute a velocity command to each of the plurality of hydraulic actuators at each computation cycle and output a control signal for controlling each of the plurality of hydraulic actuators on a basis of the computation-result velocity command to each of the plurality of hydraulic actuators,
wherein the controller is configured to:
in a case where an action of a first hydraulic actuator in the plurality of hydraulic actuators is controlled under a predetermined condition according to an action of a second hydraulic actuator,
compute an actual velocity of each of the plurality of hydraulic actuators at a current computation cycle on a basis of a sensing signal of the posture sensor,
compute a velocity command to the first hydraulic actuator at the current computation cycle such that the velocity command satisfies the condition, with use of the computation-result actual velocity of each of the plurality of hydraulic actuators and a history of past velocity commands to each of the plurality of hydraulic actuators computed at previous computation cycles before the current computation cycle,
output a control signal for controlling the first hydraulic actuator on a basis of the computation-result velocity command to the first hydraulic actuator at the current computation cycle,
compute a predicted velocity value of each of the plurality of hydraulic actuators, a predicted posture value of the work implement, and a predicted position value of the control point of the work implement relative to the target surface at a time that is a predetermined second length of time after the current computation cycle, with use of the actual velocity of each of the plurality of hydraulic actuators at the current computation cycle based on the sensing signal of the posture sensor, a history of past velocity commands to the first hydraulic actuator computed during a period from a previous computation cycle that is the second length of time before the current computation cycle until the current computation cycle, and a history of past velocity commands to each of hydraulic actuators other than the first hydraulic actuator computed during a period from a previous computation cycle that is a predetermined third length of time before the current computation cycle until a previous computation cycle that is the second length of time after the previous computation cycle that is the third length of time before the current computation cycle, the third length of time being longer than the second length of time,
compute, as the velocity command to the first hydraulic actuator at the current computation cycle, such a target velocity of the first hydraulic actuator that the control point of the work implement will be positioned on the target surface at the time that is the second length of time after the current computation cycle, on a basis of the computation-result predicted velocity values, predicted posture value, and predicted position value, and output a control signal for controlling the first hydraulic actuator on a basis of the computation-result velocity command to the first hydraulic actuator at the current computation cycle, and wherein the condition is that a predetermined control point of the work implement is positioned on a predetermined target surface.

3. A work machine comprising:

a work implement that performs work;

a plurality of hydraulic actuators that drive the work implement;

a hydraulic pump that supplies a hydraulic fluid to the plurality of hydraulic actuators;

a plurality of control valves that each control a flow of the hydraulic fluid supplied from the hydraulic pump to a corresponding one of the plurality of hydraulic actuators;

a posture sensor that senses a posture of the work implement; and a controller configured to compute a velocity command to each of the plurality of hydraulic actuators at each computation cycle and output a control signal for controlling each of the plurality of hydraulic actuators on a basis of the computation-result velocity command to each of the plurality of hydraulic actuators, wherein the controller is configured to:

in a case where an action of a first hydraulic actuator in the plurality of hydraulic actuators is controlled under a predetermined condition according to an action of a second hydraulic actuator, compute an actual velocity of each of the plurality of hydraulic actuators at a current computation cycle on a basis of a sensing signal of the posture sensor, compute a velocity command to the first hydraulic actuator at the current computation cycle such that the velocity command satisfies the predetermined condition, with use of the computation-result actual velocity of each of the plurality of hydraulic actuators and a history of past velocity commands to each of the plurality of hydraulic actuators computed at previous computation cycles before the current computation cycle, output a control signal for controlling the first hydraulic actuator on a basis of the computation-result velocity command to the first hydraulic actuator at the current computation cycle, compute a predicted velocity value of each of the plurality of hydraulic actuators, a predicted posture value of the work implement, and a predicted position value of the control point of the work implement relative to the target surface at a time that is a predetermined first length of time after the current computation cycle, with use of the actual velocity of each of the plurality of hydraulic actuators at the current computation cycle based on the sensing signal of the posture sensor and a history of past velocity commands to each of the plurality of hydraulic actuators computed during a period from a previous computation cycle that is the first length of time before the current computation cycle until the current computation cycle, compute, as the velocity command to the first hydraulic actuator at the current computation cycle, such a target velocity of the first hydraulic actuator that the control point of the work implement will be positioned on the target surface at the time that is the first length of time after the current computation cycle, on a basis of the computation-result predicted velocity values, predicted posture value, and predicted position value, and output a control signal for controlling the first hydraulic actuator on a basis of the computation-result velocity command to the first hydraulic actuator at the current computation cycle, and wherein the predetermined condition is that a predetermined control point of the work implement is positioned on a predetermined target surface.

4. The work machine according to claim 3, wherein each of the plurality of control valves is a hydraulic pilot-type control valve that is driven by an effect of a pilot pressure, and the controller is configured to:

compute a target pilot pressure for driving a control valve corresponding to each of the plurality of hydraulic actuators according to the computation-result velocity command to each of the plurality of hydraulic actuators, and output the computation-result target pilot pressure as a pilot pressure command with a delay from the current computation cycle, the delay being a length of time obtained by subtracting a predetermined fourth length of time from the first length of time, the fourth length of time being equal to or shorter than the first length of time.

5. The work machine according to claim 2, wherein the hydraulic pump has a regulator capable of changing pump displacement, and the controller is configured to:

compute target pump displacement of the hydraulic pump according to the computation-result velocity commands to the plurality of hydraulic actuators, and output, to the regulator, the computation-result target pump displacement as a pump displacement command with a delay from the current computation cycle, the delay being a length of time obtained by subtracting a predetermined fifth length of time from the third length of time, the fifth length of time being equal to or shorter than the third length of time.

6. The work machine according to claim 2, wherein each of the plurality of control valves is a hydraulic pilot-type control valve that is driven by an effect of a pilot pressure, and the controller is configured to:

compute a target pilot pressure for driving a control valve corresponding to each of the plurality of hydraulic actuators according to the computation-result velocity command to each of the plurality of hydraulic actuators, and output the computation-result target pilot pressure as a pilot pressure command with a delay from the current computation cycle, the delay being a length of time obtained by subtracting a predetermined fourth length of time from the third length of time, the fourth length of time being equal to or shorter than the third length of time.

7. The work machine according to claim 1, wherein the work implement is a front work implement including a boom and an arm, the first hydraulic actuator is a boom cylinder that drives the boom, and the second hydraulic actuator is an arm cylinder that drives the arm.

8. The work machine according to claim 3, wherein the hydraulic pump has a regulator capable of changing pump displacement, and the controller is configured to:

compute target pump displacement of the hydraulic pump according to the computation-result velocity commands to the plurality of hydraulic actuators, and output, to the regulator, the computation-result target pump displacement as a pump displacement command with a delay from the current computation cycle, the delay being a length of time obtained by subtracting a predetermined fifth length of time from the first length of time, the fifth length of time being equal to or shorter than the first length of time.

* * * * *